US011181334B2

(12) United States Patent
Sidebottom et al.

(10) Patent No.: US 11,181,334 B2
(45) Date of Patent: Nov. 23, 2021

(54) ARCHERY LIMB ADJUSTMENT SYSTEM AND METHOD FOR ARCHERY BOWS

(71) Applicant: TOG-IP LLC, Wilmington, DE (US)

(72) Inventors: Joshua J. Sidebottom, Honeoye Falls, NY (US); Nathan D. Brooks, Alma, AR (US)

(73) Assignee: TOG-IP LLC, Wilmington, DE (US)

( * ) Notice: Subject to any disclaimer, the term of this patent is extended or adjusted under 35 U.S.C. 154(b) by 0 days.

(21) Appl. No.: 16/677,951

(22) Filed: Nov. 8, 2019

(65) Prior Publication Data

US 2021/0010779 A1 Jan. 14, 2021

Related U.S. Application Data

(60) Provisional application No. 62/872,971, filed on Jul. 11, 2019.

(51) Int. Cl.
*F41B 5/14* (2006.01)

(52) U.S. Cl.
CPC ..... *F41B 5/1403* (2013.01)

(58) Field of Classification Search
CPC ..... F41B 5/10; F41B 5/14; F41B 5/1403
USPC ..... 124/23.1, 25.6, 86, 88
See application file for complete search history.

(56) References Cited

U.S. PATENT DOCUMENTS 3,595,213 A 7/1971 Storer
3,874,360 A 4/1975 Armstrong et al.
3,981,290 A 9/1976 Islas
4,244,345 A 1/1981 Simo et al.
4,756,295 A 7/1988 Guzzetta
4,955,354 A 9/1990 Bozek
5,280,779 A * 1/1994 Smith ..... F41B 5/0026 124/23.1
5,487,373 A * 1/1996 Smith ..... F41B 5/10 124/23.1
5,720,267 A * 2/1998 Walk ..... F41B 5/10 124/23.1
5,931,146 A 8/1999 Schrader et al.
6,024,076 A * 2/2000 Laborde ..... F41B 5/0026 124/23.1
6,244,259 B1 * 6/2001 Adkins ..... F41B 5/0026 124/23.1
6,712,057 B2 * 3/2004 Andrews ..... F41B 5/0026 124/23.1
6,786,214 B2 * 9/2004 Andrews ..... F41B 5/0026 124/23.1
6,941,937 B2 * 9/2005 Wheeler ..... F41B 5/10 124/23.1
7,082,937 B1 8/2006 Land
(Continued)

FOREIGN PATENT DOCUMENTS

WO 2001/194870 12/2001

*Primary Examiner* — Alexander R Niconovich
(74) *Attorney, Agent, or Firm* — Barclay Damon LLP

(57) ABSTRACT

An archery limb adjustment system and method for archery bows are disclosed herein. The archery limb adjustment system, in an embodiment, includes an archery limb holder configured to be coupled to an archery bow, a pivot member configured to be coupled to the archery bow, and an archery limb adjuster operatively coupled to the archery limb holder. The archery limb adjuster is configured to receive an input. As a result of the input, the archery limb holder is configured to pivot relative to the archery bow.

21 Claims, 19 Drawing Sheets

(56) References Cited

U.S. PATENT DOCUMENTS 7,721,721 B1 5/2010 Kronengold et al.
7,762,245 B2 * 7/2010 Smith ..... F41B 5/10 124/25.6
7,784,452 B1 * 8/2010 Kronengold ..... F41B 5/10 124/23.1
7,832,387 B1 * 11/2010 Yehle ..... F41B 5/0094 124/25.6
7,913,680 B2 3/2011 Evans
7,980,236 B1 7/2011 Kronengold et al.
8,047,189 B2 11/2011 McPherson
8,281,773 B2 * 10/2012 Dahl, II ..... F41B 5/10 124/25.6
8,776,770 B2 * 7/2014 Batdorf ..... F41B 5/1403 124/23.1
8,844,508 B2 * 9/2014 Sims ..... F41B 5/10 124/25
9,389,039 B2 * 7/2016 Denton ..... F41B 5/14
9,581,406 B1 * 2/2017 Nevels ..... F41B 5/0031
9,976,831 B2 * 5/2018 Badgerow ..... F41B 5/1403
10,184,750 B2 * 1/2019 McPherson ..... F41B 5/123
10,883,791 B2 * 1/2021 Webster ..... F41B 5/1403
2003/0084893 A1 * 5/2003 Andrews ..... F41B 5/10 124/23.1
2004/0094139 A1 5/2004 Andrews
2006/0011181 A1 1/2006 Andrews
2007/0256675 A1 * 11/2007 Smith ..... F41B 5/10 124/25.6
2008/0127961 A1 * 6/2008 McPherson ..... F41B 5/10 124/88
2009/0145411 A1 * 6/2009 Sims ..... F41B 5/10 124/25.6
2009/0241928 A1 * 10/2009 Blosser ..... F41B 5/0026 124/25.6
2010/0263650 A1 * 10/2010 Dahl, II ..... F41B 5/105 124/25.6
2014/0041645 A1 2/2014 Wasilewski et al.
2016/0091273 A1 * 3/2016 Denton ..... F41B 5/00 124/23.1
2020/0355459 A1 * 11/2020 Webster ..... F41B 5/0026

* cited by examiner

ARCHERY LIMB ADJUSTMENT SYSTEM AND METHOD FOR ARCHERY BOWS

CROSS-REFERENCE TO RELATED APPLICATION

This application is a non-provisional of, and claims the benefit and priority of, U.S. Provisional Patent Application No. 62/872,971 filed on Jul. 11, 2019. The entire contents of such application are hereby incorporated herein by reference.

BACKGROUND

There are various types of archery bows, such as recurve bows, compound bows and crossbows. The bows typically include a handle and a main frame, such as a riser, in the case of recurve and compound bows. The bows also include one or more flexible limbs mounted to the main frame. The archery limbs, connected to a bowstring, function like a spring to propel an arrow toward a target. Depending on the type of bow, the bow may also include rotatable cams connected to the ends of the archery limbs.

The performance of the bow can depend on the unique characteristics of the archer. For example, an archer can have a unique anatomy (such as a unique arm length, unique muscle distribution, and unique skeletal structure), unique skills and hand-eye coordination, unique psychological traits, and unique preferences. Furthermore, the archer's unique anatomy can include asymmetries. For example, the archer's left shoulder could be slightly lower than the archer's right shoulder, or the archer's spine and torso could be slightly curved to the right or to the left.

Because of these archer-specific characteristics, archers typically find it desirable to customize their bows by adjusting certain features. For example, some bows have an adjustable limb pocket, the part that mounts the archery limb to the main frame. The known limb pocket enables the archer to adjust the bowstring tension or draw weight, but it does not enable the archer to tune or adjust other features of the bow. This adjustment is limited to the draw weight adjustment. Accordingly, the known limb pocket fails to enable archers to make other adjustments or tuning based on the archery limbs.

The foregoing background describes some, but not necessarily all, of the problems, disadvantages and shortcomings related to the known approaches for customizing or tuning archery bows.

SUMMARY

An embodiment of an archery limb adjustment system comprises an archery limb holder configured to be coupled to an archery bow, wherein the archery limb holder is configured to hold an archery limb that comprises a plurality of archery limb portions, wherein each of the archery limb portions comprises a top surface, and wherein a plane extends through the top surfaces of the archery limb portions when the archery limb comprises a first shape. A pivot member is configured to be coupled to the archery bow, wherein the pivot member is configured to pivotally support the archery limb holder. An archery limb adjuster is operatively coupled to the archery limb holder and is configured to receive an input. The archery limb holder, the pivot member and the archery limb adjuster are configured to cooperate so that, in response to the input, the archery limb holder is configured to pivot relative to the archery bow when the archery limb holder and the pivot member are coupled to the archery bow. As a result of the pivoting of the archery limb holder, the archery limb is transitioned to a second shape in which one of the top surfaces is at least partially moved above the plane, and another one of the top surfaces is at least partially moved below the plane.

In another embodiment, the archery limb adjustment system comprises an archery limb holder configured to be coupled to an archery bow, a pivot member configured to support the archery limb holder, and an archery limb adjuster operatively coupled to the archery limb holder. The archery limb adjuster is configured to receive an input and, in response to the input, the archery limb holder, the pivot member and the archery limb adjuster are configured to cooperate so that the archery limb holder is configured to pivot relative to the archery bow when the archery limb holder and the pivot member are coupled to the archery bow.

A method for manufacturing an archery limb adjustment system comprises configuring an archery limb holder to be coupled to an archery bow, configuring a pivot member to support the archery limb holder, and configuring an archery limb adjuster so as to be operatively coupled to the archery limb holder and so as to receive an input. The archery limb holder, the pivot member and the archery limb adjuster are configured to cooperate so that, in response to the input, the archery limb holder is configured to pivot relative to the archery bow when the archery limb holder and the pivot member are coupled to the archery bow.

Additional features and advantages of the present disclosure are described in, and will be apparent from, the following Brief Description of the Drawings and Detailed Description.

DETAILED DESCRIPTION

Figure 1:
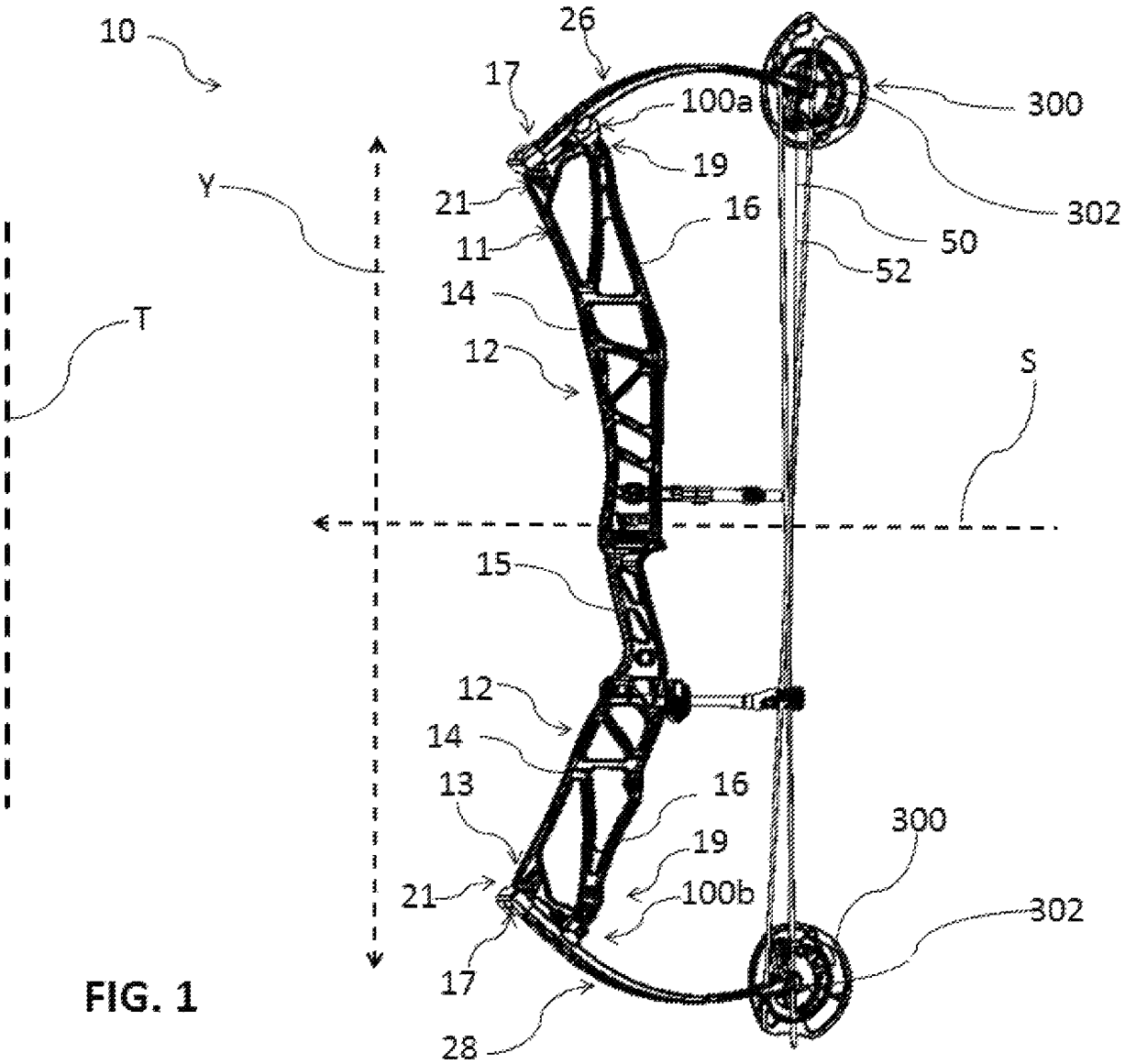
FIG. 1 is a side elevation view of an embodiment of an archery bow with a limb adjustment system.
Figure 2:
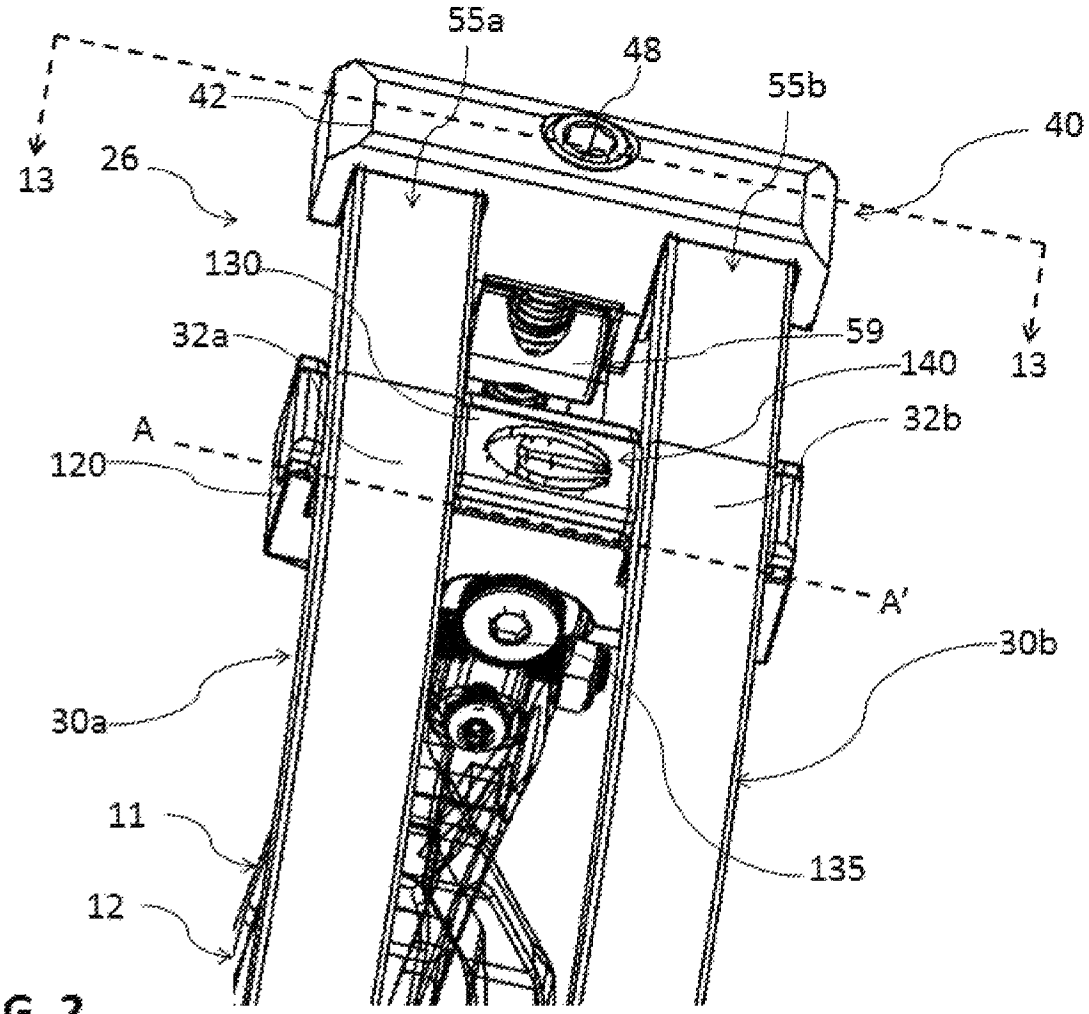
FIG. 2 is a top isometric view of a portion of the archery bow of FIG. 1 showing an embodiment of an archery limb adjustment system coupled to the archery bow riser where the archery bow riser is shown in a transparent view.
Figure 3:
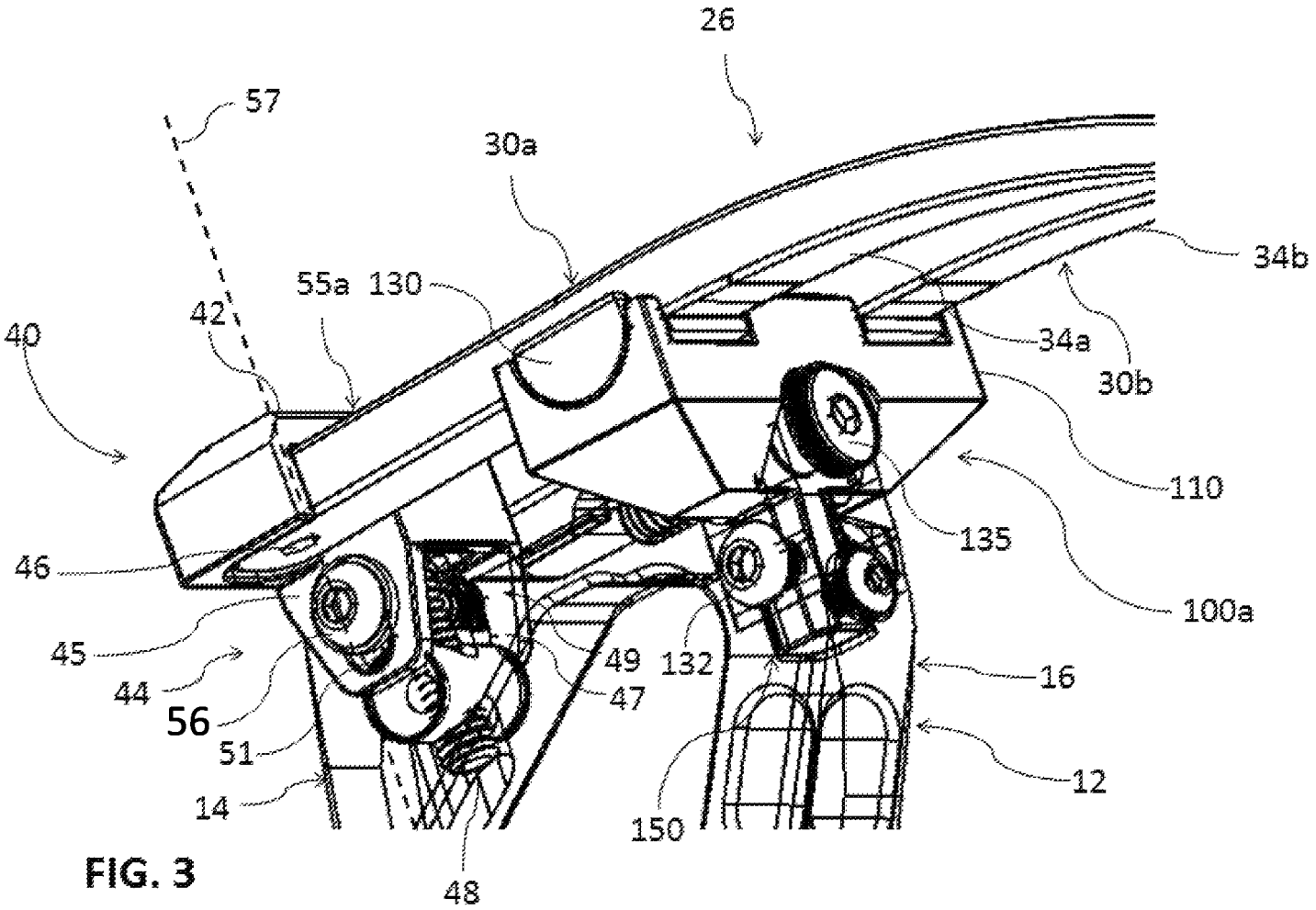
FIG. 3 is a side isometric view of the archery limb adjustment system of FIG. 2.
Figure 4:
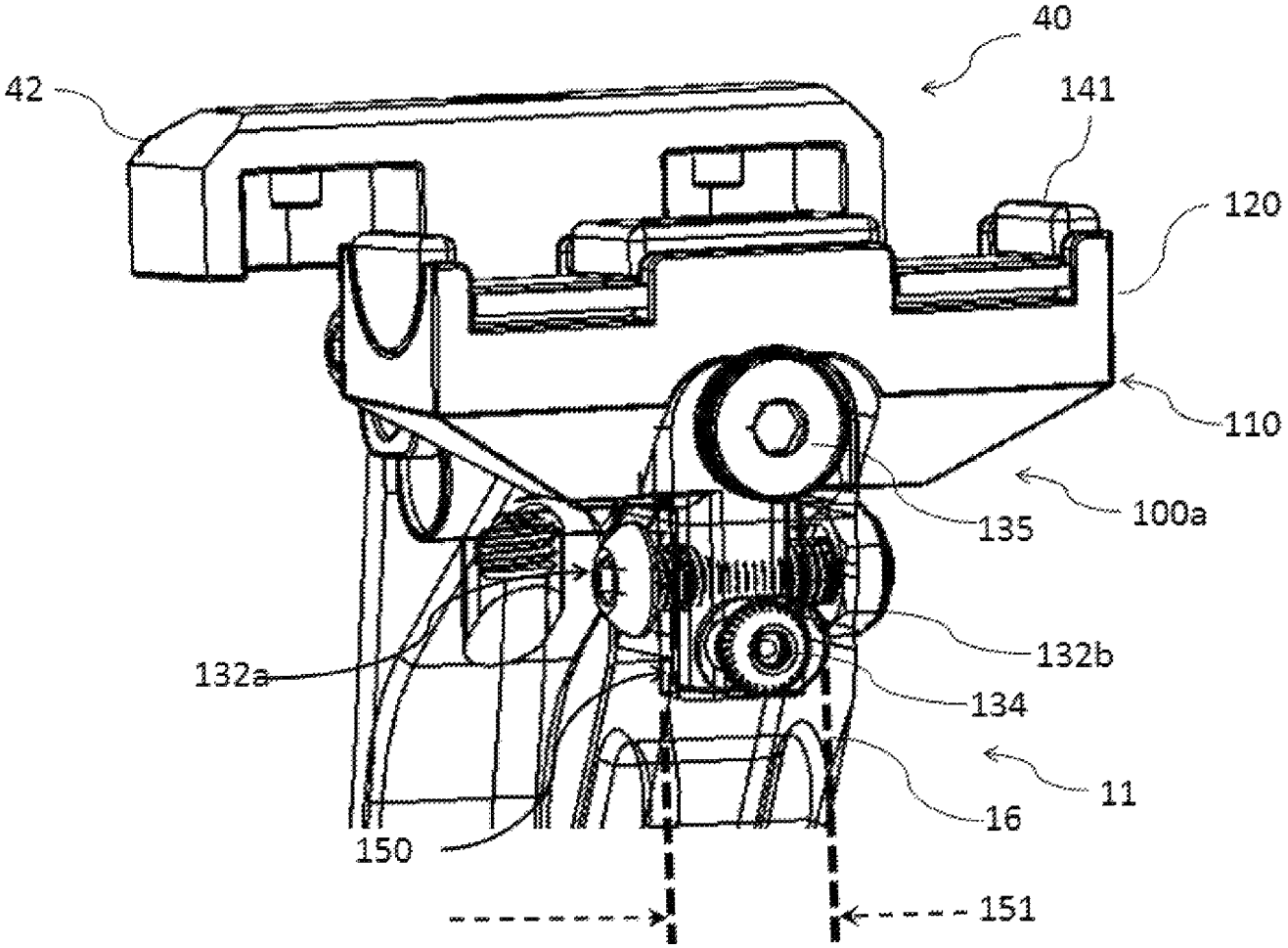
FIG. 4 is rear isometric view of the archery limb adjustment system of FIG. 2 with the archery limbs removed.

Referring to FIGS. 1-3, an archery bow 10 includes: (a) a grasp or handle 15, a frame, structure or riser 12 extending upward and downward from the handle 15; (b) upper and lower archery limbs 26, 28, respectively, extending from the handle 15; (c) a plurality of cams, disks, pulleys or rotors 300, each of which is rotatable coupled one of the archery limbs 26, 28; (d) a bowstring or draw cord 50 coupled to the rotors 300; and (e) power cables or supplemental cords 52. The supplemental cords 52 are coupled to the rotors 300 and are also anchored to the archery limbs 26, 28.

Each of the archery limbs 26, 28 includes archery limb portions 30*a*, 30*b*, as shown in FIG. 2. In this embodiment, the archery limb portions 30*a*, 30*b* are spaced apart from each other in a split-limb configuration as shown in FIG. 2. When the archery bow 10 is drawn, the archery limb portions 30*a*, 30*b* bend or flex. Each of the archery limbs 26, 28 (and each of the archery limb portions 30*a*, 30*b*) has an elastic characteristic. While flexing as springs, the elasticity of the archery limb portions 30*a*, 30*b* causes an accumulation of potential energy. In the embodiment illustrated, each of the rotors 300 has an asymmetric portion or lever arm, at least one groove configured to receive the draw cord 50, and at least one supplemental groove configured to receive the supplemental cord 52. The asymmetry of the rotors 300, in conjunction with the effect of the supplemental cords 52, increases leverage and makes it easier for the archer to retract the draw cord 50. Although the illustrated archery bow 10 is a compound bow, it should be appreciated that the archery bow 10 can be a recurve bow, a crossbow, a fishing bow or any other type of bow or weapon configured to propel a projectile based on the elasticity of one or more archery limbs.

As the draw weight increases and decreases over the course of the draw cycle, the tensions on the draw cord 50 and supplemental cords 52 change. At full draw, the draw cord 50 has relatively low tension and the supplemental cords 52 are at their maximum amount of tension. In contrast, the archery bow 10 in its resting state, as shown in FIG. 1, has relatively low tension in the supplemental cords 52 and draw cord 50.

Figure 1B:
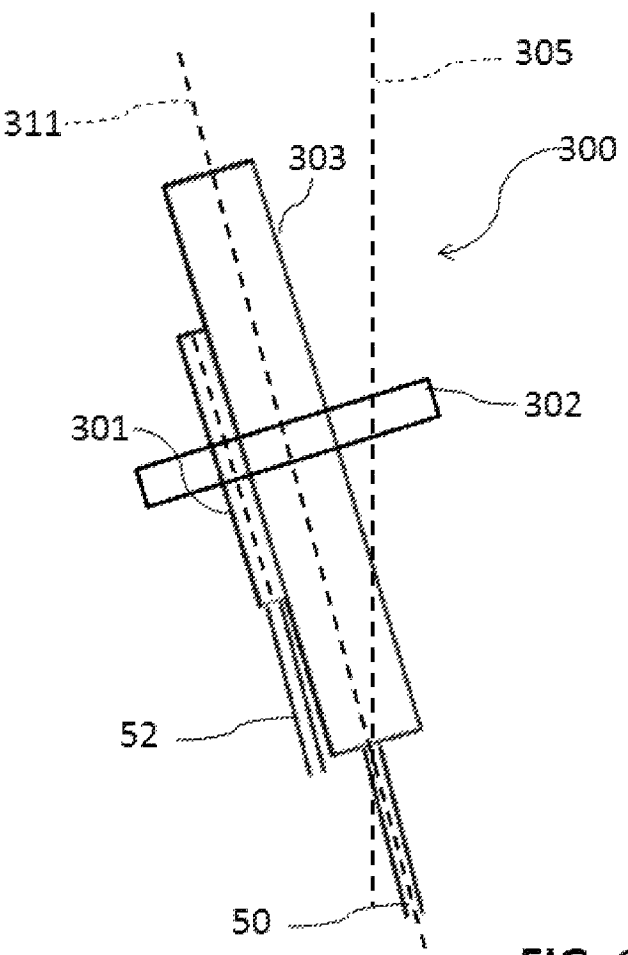
FIG. 1B is a schematic rear view of a rotor from FIG. 1 in a tilted position relative to a vertical axis.
Figure 1A:
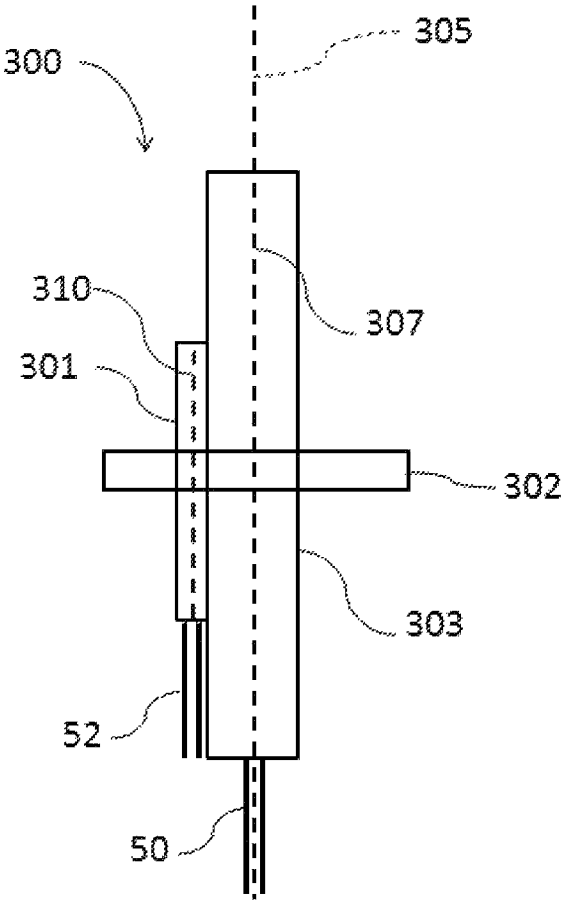
FIG. 1A is schematic rear view of an embodiment of a rotor from the archery bow of FIG. 1 in a vertical position along a vertical axis.
Figure 16:
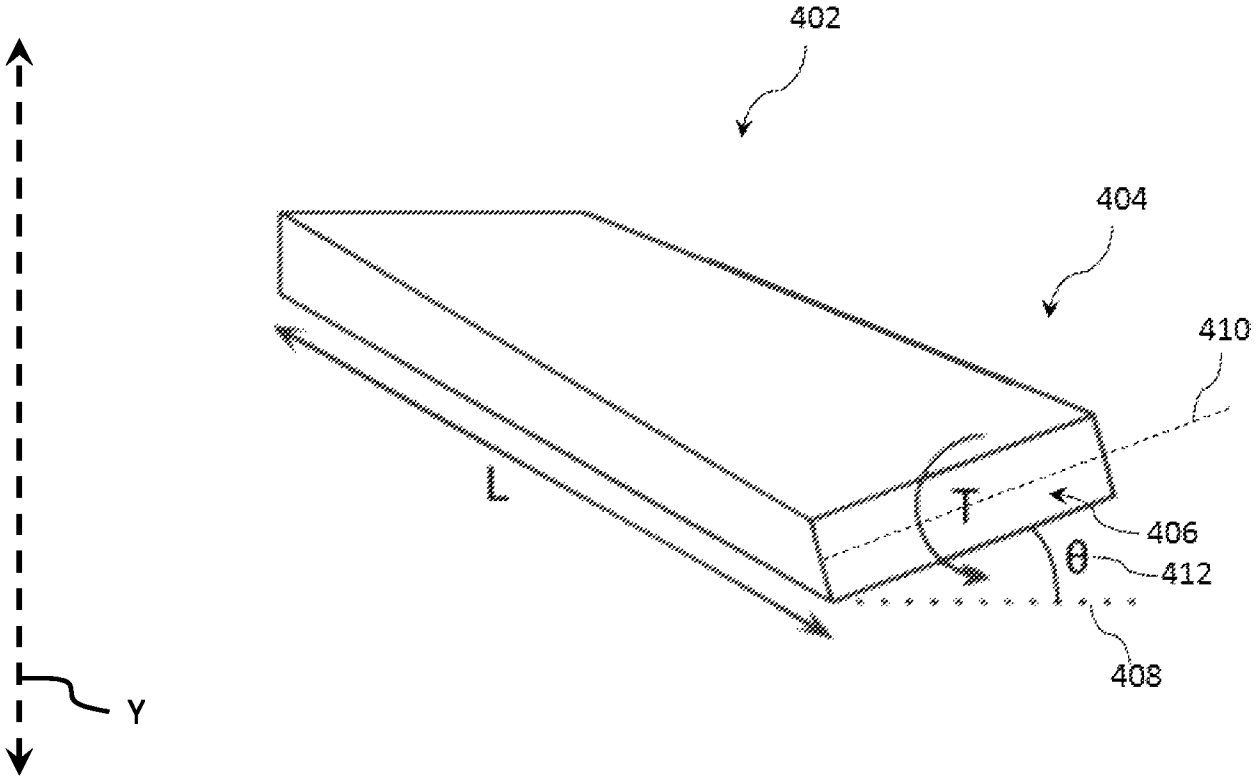
FIG. 16 an isometric view of an archery limp portion that has been partially twisted in response to the operation of the archery limb adjustment system of FIG. 14 or 15B.

In the embodiment illustrated in FIGS. 1A and 1B, each rotor 300 has a plurality of sides 301, 303. A neutral central plane 305 is centrally located between such sides 301, 303. In the example shown, the neutral central plane 305 is parallel or substantially parallel with the vertical axis Y shown in FIG. 1. The rotor 300 has a draw cord engaging groove 307 aligned with the neutral central plane 305. The rotor 300 also has a supplemental cord engaging groove 310 that is offset from the central plane 305. The forces of the supplemental cords 52 can cause the rotor 300 to lean or tilt to the right or to the left depending on the orientation of the rotor 300. In the example shown in FIGS. 1A and 1B, the force of the supplemental cords 52 caused the rotor 300 to tilt or lean to the left, creating an angle between the neutral central plane 305 and the tilted central plane 311. The leaning or tilting of the rotor 300 can cause either or both of the archery limb portions 30*a*, 30*b* (FIG. 2) to twist in shape as shown in FIG. 16.

Figure 1D:
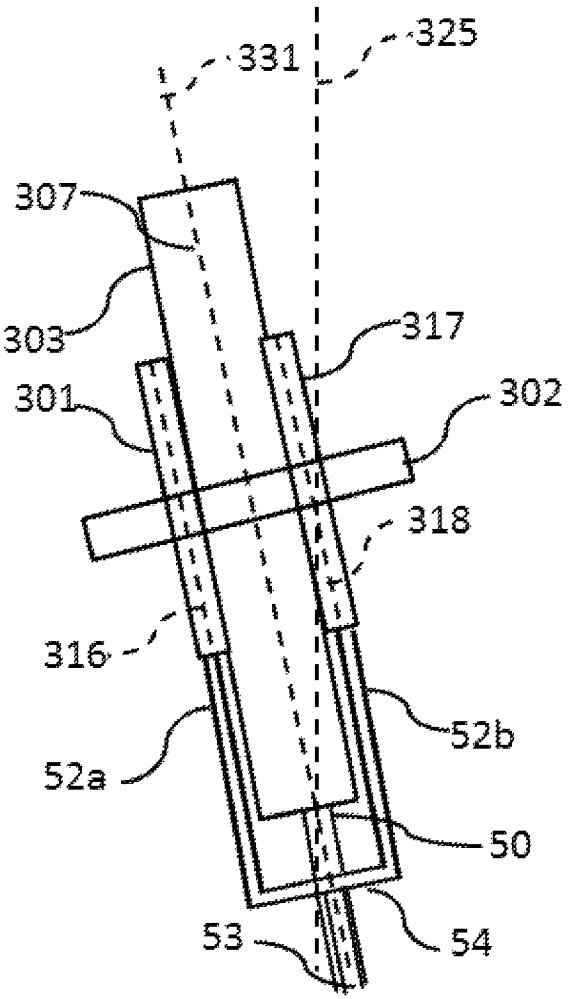
FIG. 1D is a schematic rear view of the embodiment of the rotor from FIG. 1C in a tilted position relative to a vertical axis.
Figure 1C:
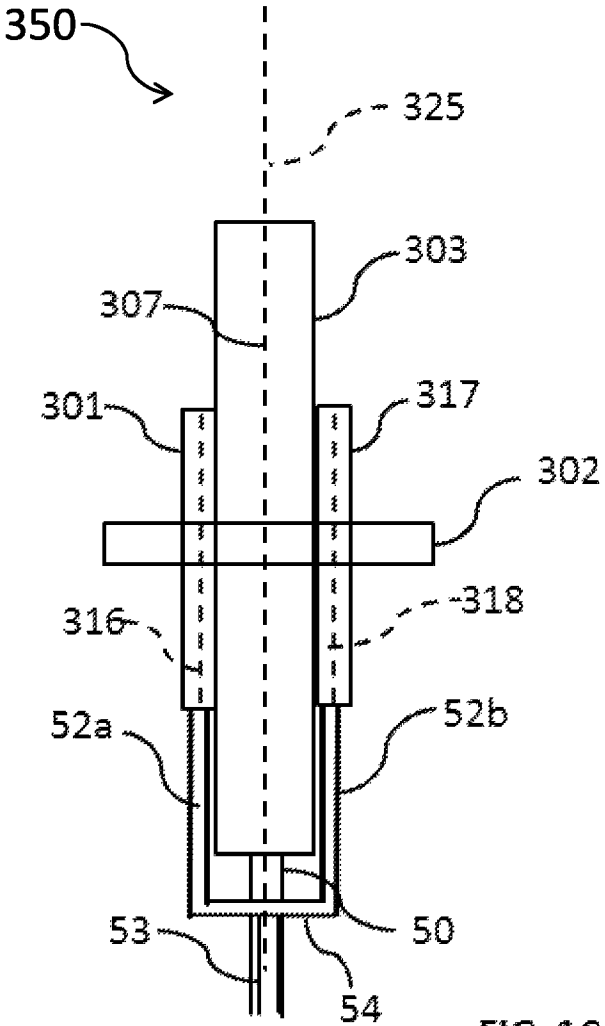
FIG. 1C is a schematic rear view of another embodiment of a rotor in a vertical position along a vertical axis.

In the embodiment illustrated in FIGS. 1C and 1D, rotor has the same structure, elements and functionality as rotor 300 except that rotor 350 has a plurality of sides 301, 317. A neutral central plane 325 is centrally located between such sides 301, 317. In the example shown, the neutral central plane 325 is parallel or substantially parallel with the vertical axis Y shown in FIG. 1. The rotor 350 has a draw cord engaging groove 307 aligned with the neutral central plane 325. The rotor 350 also has supplemental cord engaging grooves 316, 318 that are offset from the central plane 325. The individual supplemental cords 52*a*, 52*b* are coupled by a link 54 and a single supplemental cord 53 extends from the link 54. In an embodiment, the single supplemental cord 53 extends between the link 54 and an opposing link (not shown) associated with the second cam. The variation in loading on the axle 302 throughout the draw cycle can cause the rotor 350 to lean or tilt to the right or to the left depending on the archer's anatomy and forces (as well as characteristics of the bow including limb deflection or stiffness). In the example shown in FIGS. 1C and 1D, the uneven forces acting on the axle 302 cause the rotor 300 to tilt or lean to the left, creating an angle between the neutral central plane 325 and the tilted central plane 331.

Another factor that can influence rotor lean is the differences in the stiffness of the archery limb portions 30*a*, 30*b*. For example, if archery limb portion 30*a* is stiffer than limb portion 30*b*, this can cause rotor 300 or 350 to lean. Depending on the archer's unique preferences and unique anatomy, the archer may desire for the rotor 300 or 350 to lean or tilt by a desired angle. The desired angle may enable the archer to establish a tilt angle that is preferred over an undesirable angle of tilt. The undesirable tilt may have been caused by the supplemental cords 52 or other mechanics of the archery bow 10. Also, the desired angle of tilt may enable the archer to establish an angle that is compatible with the archer's unique anatomy (such as a unique arm length, unique muscle distribution, and unique skeletal structure), unique skills and hand-eye coordination, and unique psychological traits.

As described below, each of the archery limb adjustment systems (or limb adjustment systems) 100*a*, 100*b*, 200 enables the archer to conveniently adjust the rotor lean or tilt to achieve an optimal, archer-specific angle based on the archer's fine tuning and performance preferences. The limb adjustment system 100*a* enables the archer, installer or user to control the amount of rotor tilt, which, in turn, enables the archer to avoid or reduce the introduction of: (a) undesirable vibrations into the archery bow 10, which can impair the control and detract from force transfer from the archery bow 10 to the arrow; (b) lateral forces onto the arrow that impair flight accuracy of the arrow or otherwise detract from the launching force; (c) wear and tear on the archery limb portions 30*a*, 30*b*, the rotors 300, 350 (or ball bearings therein) and other parts of the archery bow 10; and (d) excessive or undesirable rotor tilt, which can cause derailment of the draw cord 50 or supplemental cords 52.

Referring back to FIG. 1, the riser 12 of the archery bow 10 at least partially extends along a vertical axis Y or riser axis Y, and the archery bow 10 has a first riser end 11 and a second riser end 13. The handle 15 is positioned along the riser 12 and is configured to enable an archer to securely grip the archery bow 10. The first and second riser ends 11, 13 are coupled to, and support, the archery limbs 26, 28, respectively. As shown in FIG. 1, each of the archery limbs 26, 28 extends from a front surface 14 of the riser 12 beyond a rear surface 16 of the riser 12. The archery limbs 26, 28 are coupled to the riser 12 using one or more archery riser couplers 40 (FIG. 2). Referring to FIG. 1, in an alternate embodiment not shown, the front limb portion 17 of each of the archery limbs 26, 28 is coupled to the rear riser portion 19 instead of the front riser portion 21.

As shown in FIG. 1, a plurality of limb adjustment systems 100*a*, 100*b* are coupled to the upper and lower archery limbs 26, 28, respectively. In the embodiment shown, the limb adjustment system 100*b* is identical to (and installed as a mirror image of) the limb adjustment system 100*a*. Accordingly, the description of limb adjustment system 100*a* is a description of limb adjustment system 100*b*.

When the archer aims the archery bow 10, the front surface 14 faces the target T, and the rear surface 16 faces toward the archer. The bowstring or draw cord 50 extends between the archery limbs 26, 28 and is configured to propel a projectile (e.g., an archery arrow or bolt) along a shooting axis S towards the target T. As shown in FIGS. 1-1D, each of the rotors 300, 350 is rotatably supported by an axle 302 that is mounted to one of the archery limbs 26, 28.

FIGS. 2-3 illustrate an enlarged view of the first riser end 11 of the riser 12 showing a transparent view of the riser 12. In this embodiment, the archery limb 26 has a split limb configuration with a left archery limb portion 30*a* and a right limb portion 30*b*, however in other embodiments the archery bow 10 can have a continuous, solid limb. The right archery limb portion 30*a* and the left limb portion 30*b* are each coupled to the riser 12 by a riser fastener 48 or riser coupler 40.

As shown in FIGS. 2-3, the archery riser coupler 40 has a limb engagement portion 42 that receives and contacts the archery limb portions 30*a*, 30*b*. The archery riser coupler 40 also has a mount or anchor 44 that is configured to couple to the riser 12. The limb engagement portion 42 may further couple to and secure the archery limb portions 30*a*, 30*b* to the archery riser coupler 40 via one or more fastening members (not shown) that extend through openings (e.g., opening 46) into the archery limb portions 30*a*, 30*b*.

In an embodiment, the anchor 44 has a plurality of arms 45, 47 that are spaced apart from each other. The arms 45, 47 define a space 49 configured to receive a portion of the first riser end 11. Also, each of the arms 45, 47 defines an opening 51 configured to receive a fastener 56. The opening 51 has a non-circular, elongated shape that is larger than the diameter of the shaft of the fastener 56. Accordingly, the shaft of the fastener 56 can be adjustably positioned to change the distance between the first riser end 11 and the front ends 55*a*, 55*b* of the archery limb portions 30*a*, 30*b*, respectively. In the example shown, this adjustment can occur along the axis 57. For example, the front ends 55*a*, 55*b* can be separated from the first riser end 11 by a distance along the axis 57. As shown in FIG. 2, the fastener 48 extends through the space 49 and is received by the nut 59. By rotating the fastener 48, the archer, installer or user can tighten and secure the limb engagement portion 42 to the first riser end 11.

Figure 5:
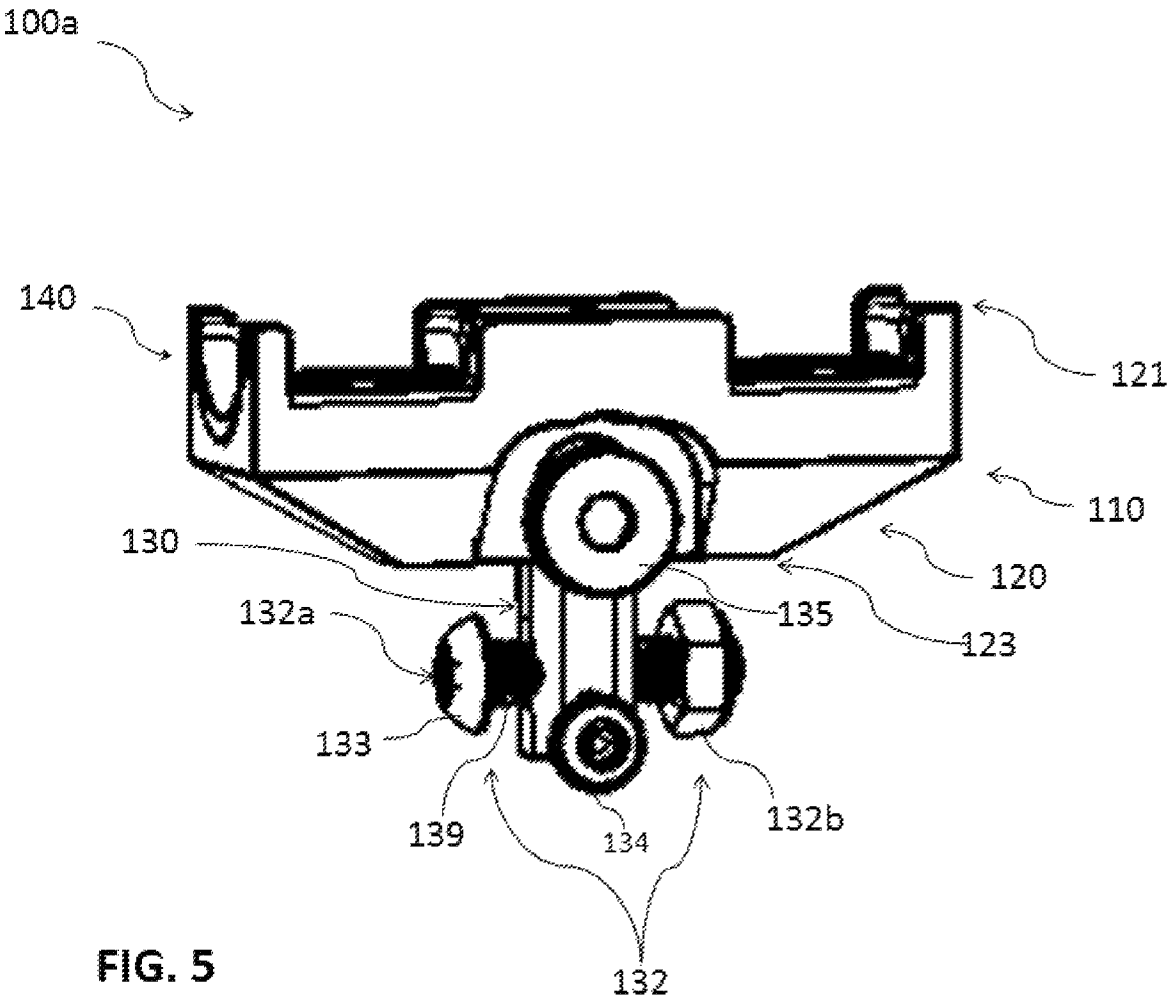
FIG. 5 is a rear isometric view of an embodiment of the archery adjustment system of FIG. 2 detached from the archery bow.

Referring to FIGS. 2-5, the archery limb adjustment system 100*a* is positioned opposite the archery riser coupler 40 on the first riser end 11 of the riser 12 and generally towards or adjacent to the rear surface 16 (FIG. 1). In other words, the archery limb adjustment system 100*a* is located rearward of the front surface 14 (FIG. 1). As illustrated in FIG. 5, the archery limb adjustment system 100*a* includes an archery limb holder 110 and a limb adjuster or position adjuster 132.

Figure 6:
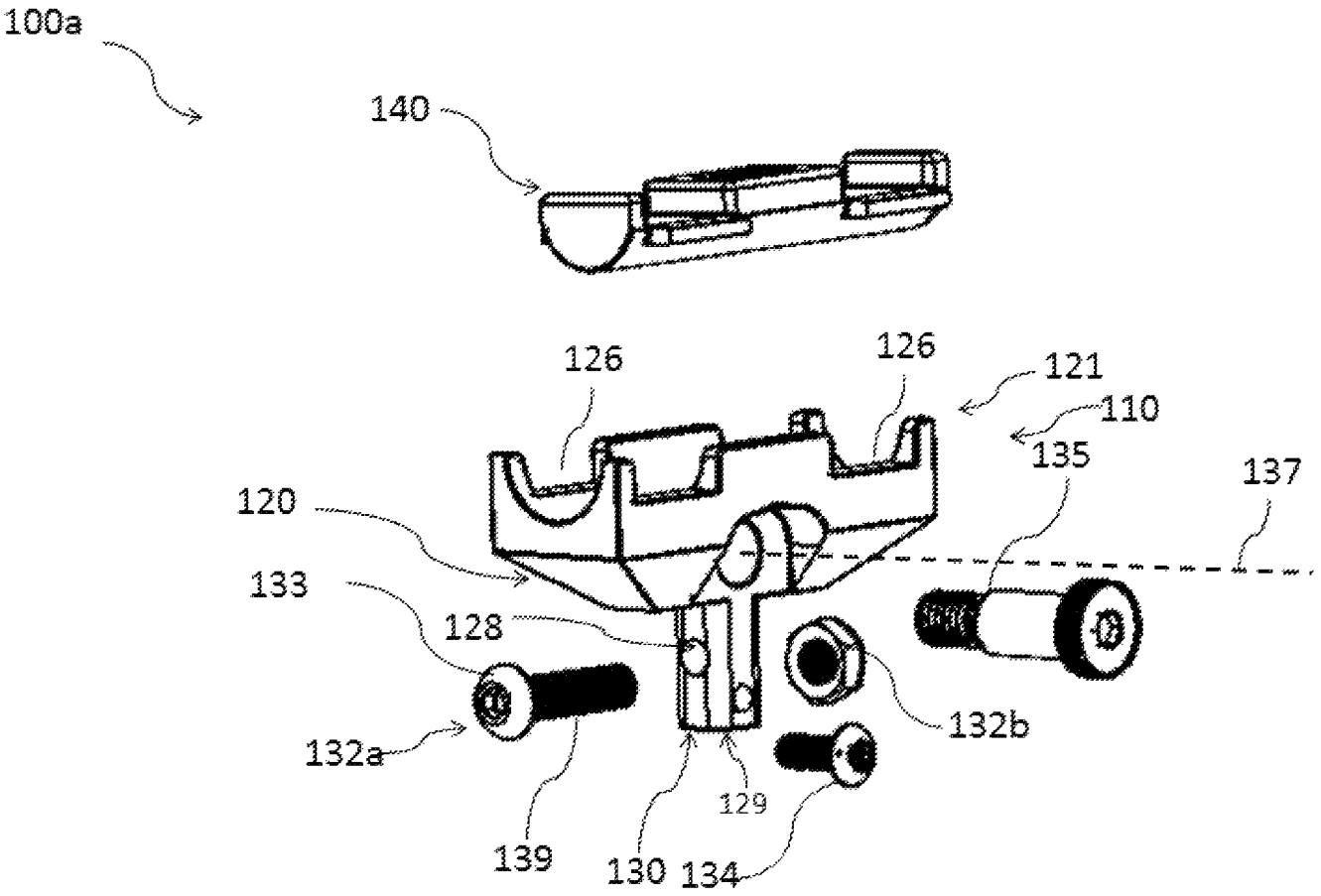
FIG. 6 is an exploded isometric view of the archery limb adjustment system of FIG. 5.

As illustrated in FIG. 6, the archery limb holder 110 includes a base portion 120, a support portion 140, and a seat 141 configured to engage the archery limb portions 30*a*, 30*b*. In the embodiment shown, the support portion 140 and the seat 141 are formed as single, unitary component. In other embodiments, the support portion 140 and the seat 141 can be separate components that are attached or coupled together.

In an embodiment, the seat 141 is removable and configured to engage the archery limb portions 30*a*, 30*b*. In an embodiment not shown, the archery limb adjustment system 100*a* has a kit that includes a set of different seats 141. Each such seat 141 has a different dimension or geometric characteristic associated with a designated archery bow, limb type or archer preference.

As shown in FIGS. 5-9, the archery limb holder 110 includes a top 121 defining one or more recesses 126 and further defining a cavity 125 (FIG. 9) that is configured to receive at least part of the seat 141. The base portion 120 has a neck, base extension or base member 130 that extends from a bottom end 123 of the base portion 120. As shown in FIGS. 3-6, the position adjuster 132 is configured to be operatively coupled to the base member 130 and receive an input, such as a rotational, adjustment force provided by a user. In the other embodiments, the input can include a pushing force, a pulling force or any other type of force, impact or motion.

Referring to FIG. 5, in an embodiment, the position adjuster 132 includes first and second adjuster portions 132*a*, 132*b*. In the embodiment shown, the first adjuster portion 132*a* is a screw or bolt, and the second adjuster portion 132*b* is a threaded nut. The first adjuster portion 132*a* includes a head 133 and an extension or shaft 139 that is fully or partially threaded. A position lock 134 is further coupled to the base member 130. The position adjuster 132 and the position lock 134 are each configured to be accepted by respective first and second channels 128, 129 extending at least partially though the base member 130.

Figure 9:
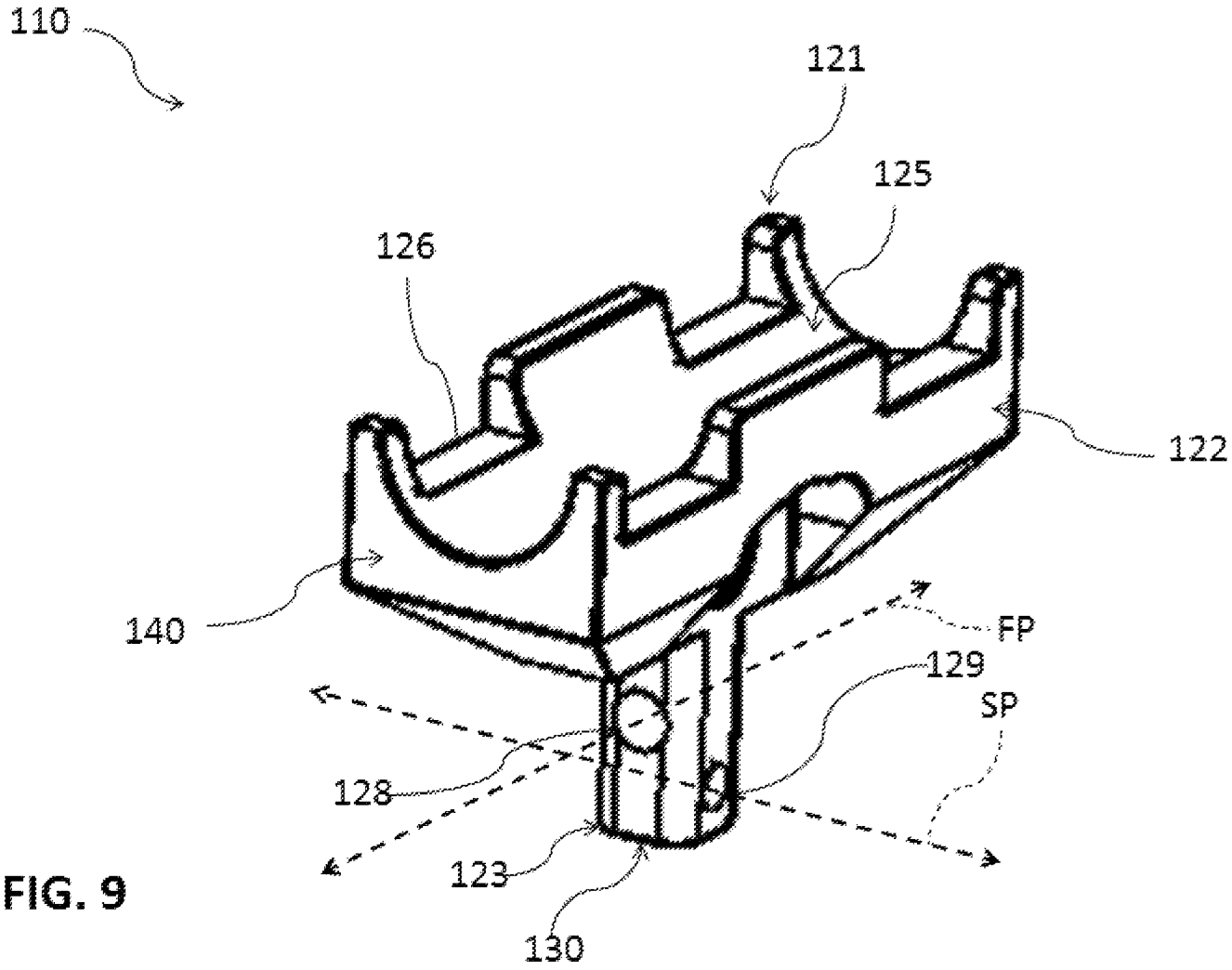
FIG. 9 is a top isometric view of the base portion of FIG. 7.

As shown in FIG. 9, the first channel 128 extends along a first channel axis FP and passes entirely through the base member 130, and the second channel 129 extends along a second channel axis SP that is traverse to first channel axis FP. In an embodiment, the second channel 129 does not extend entirely through the base member 130. In an embodiment, the base member 130 has a first threaded surface that defines the first channel 128, and the base member 130 has a second threaded surface that defines the second channel 129. In an embodiment, one or more components of the position adjuster 132 are formed as a single unitary component with the archery limb holder 110.

Referring back to FIGS. 7-8 and 10, a pivot portion 127 extends between a front surface 122 (FIG. 10) and a rear surface 124 of the base portion 120 and is configured to accept a pivot member 135 (FIGS. 5 and 10) that extends along an axis of rotation R (FIG. 10). In the embodiment shown, the pivot portion 127 defines a bore, recess or channel 127*a* defined by the base portion 120. In this embodiment, the channel 127*a* passes entirely through the base portion 120. In another embodiment not shown, the channel 127*a* is a recess that extends only partially into the base portion 120. Depending on the embodiment, the pivot portion 127 can be a shoulder, a socket, a joint member, a notch, a valley or any other structure configured to be pivotally, dynamically or moveably engaged with the pivot member 135.

Figure 10:
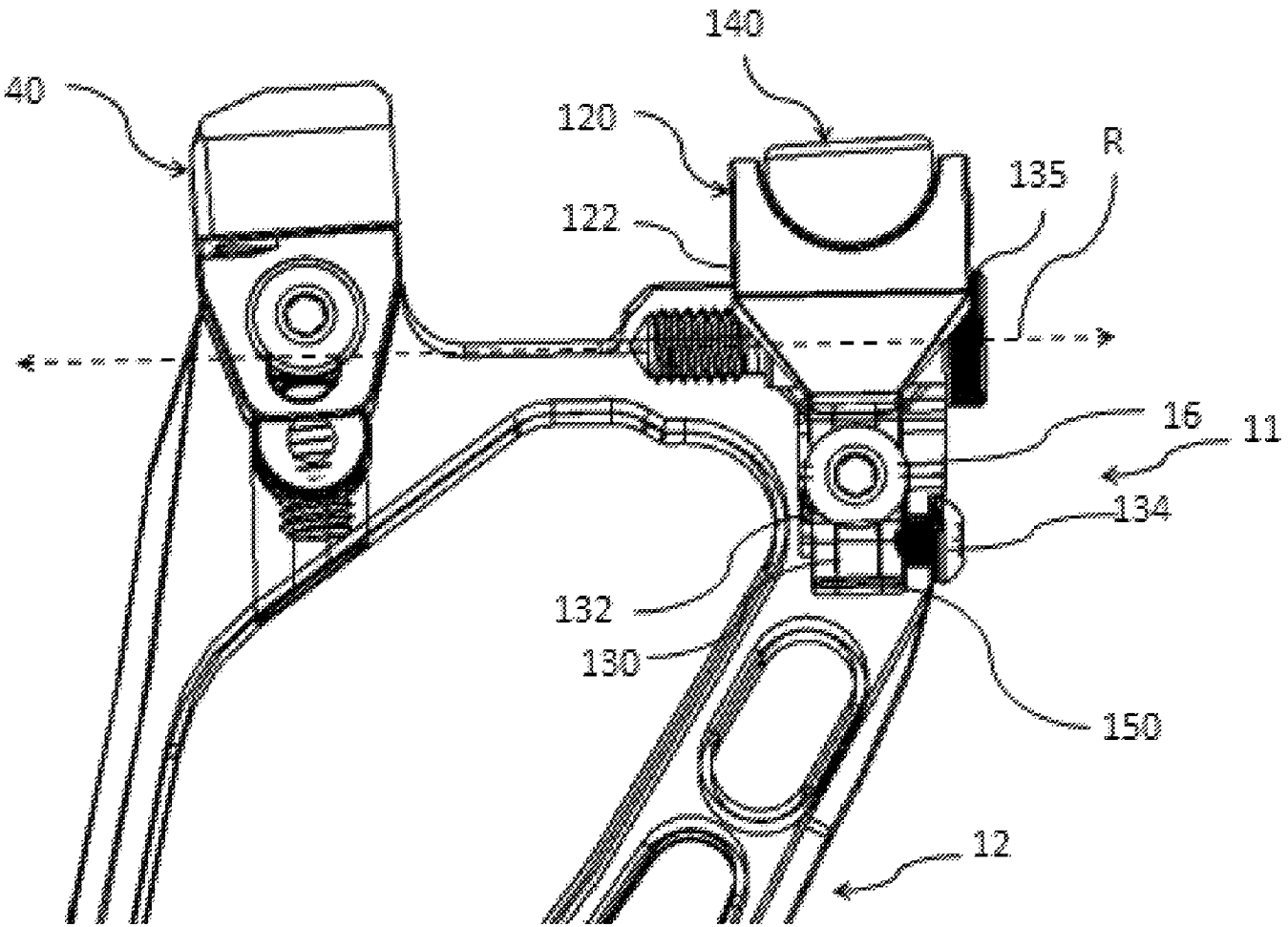
FIG. 10 is a side elevation view of the archery limb adjustment system of FIG. 4.
Figure 11:
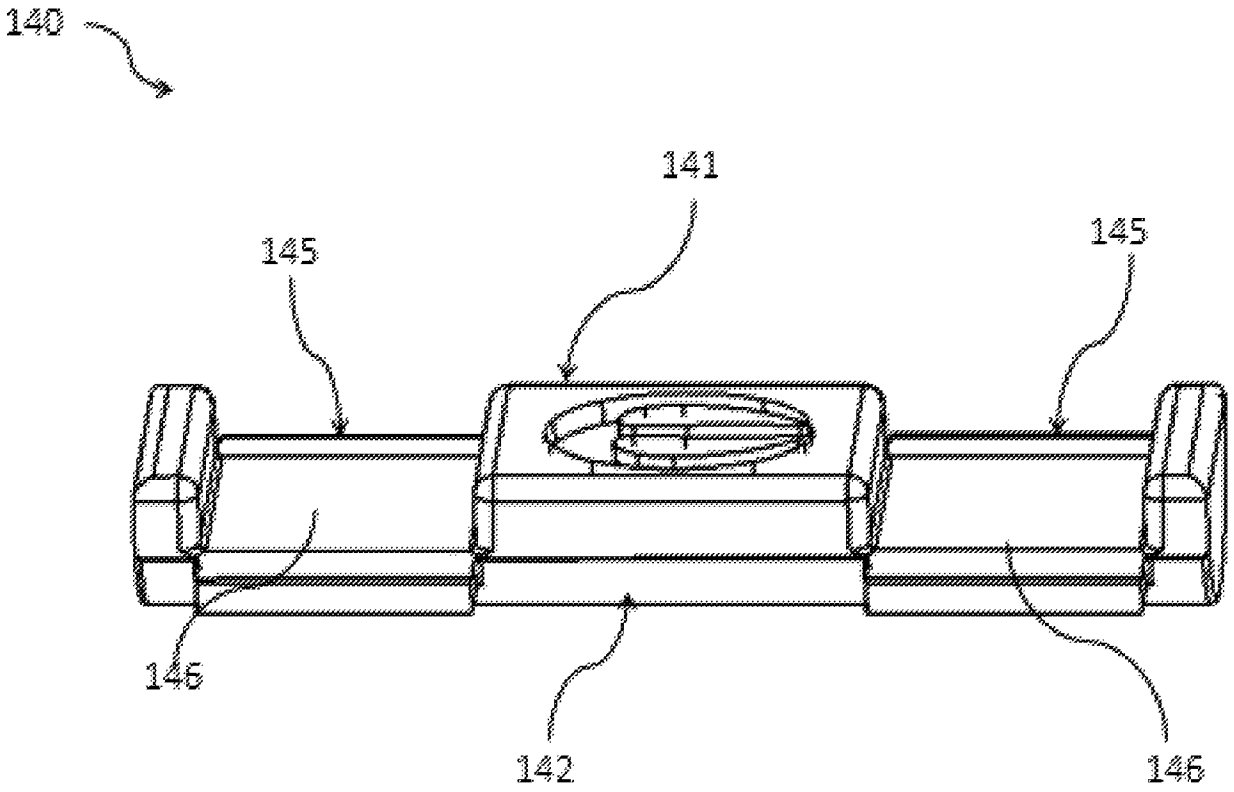
FIG. 11 is a top isometric view of the support portion of FIG. 7.
Figure 12:
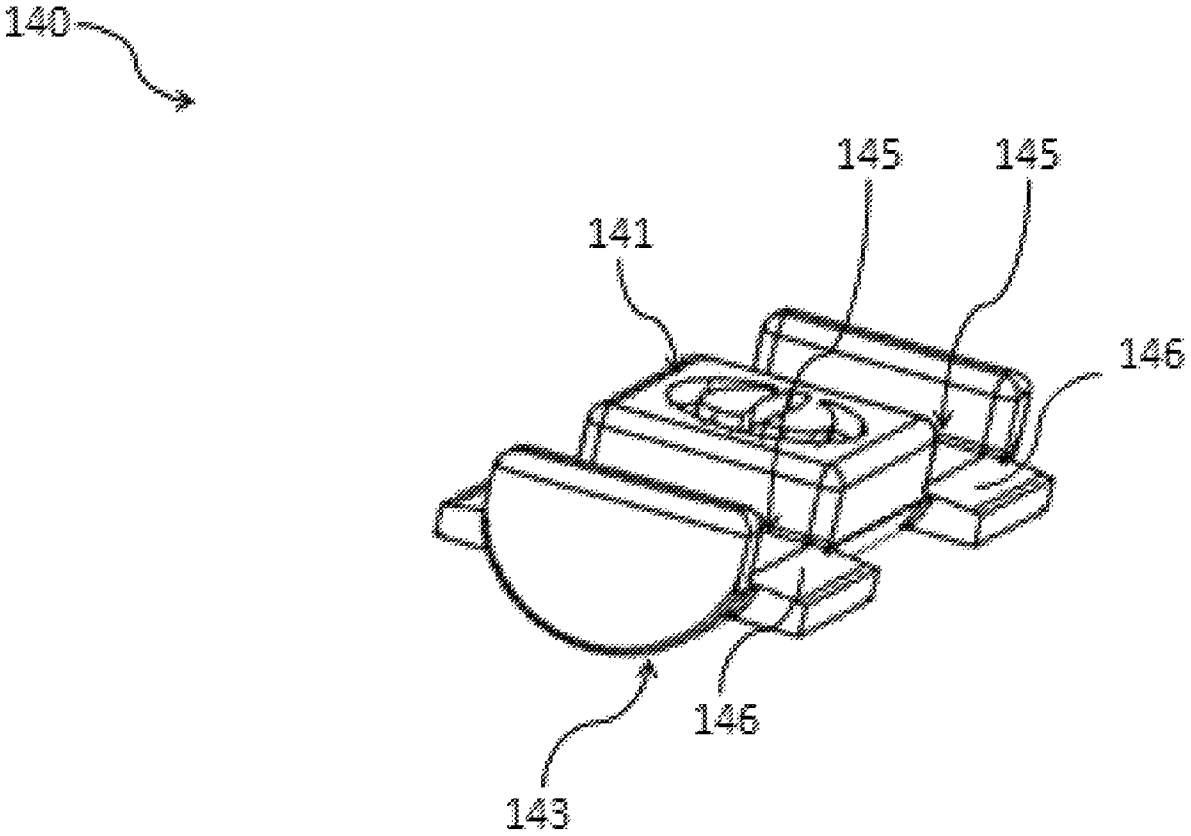
FIG. 12 is another top isometric view of the support portion of FIG. 7.

As shown in FIG. 10, the pivot member 135 couples the archery limb holder 110 to the first riser end 11 and supports the archery limb 26. In the embodiment shown in FIG. 6, the pivot member 135 is a fastener, such as a screw or bolt. However, depending on the embodiment, the pivot member 135 can be any suitable fulcrum member or coupling member, such as a pin, rod, shaft, ball, joint, hinge or other suitable device that enables the support portion 140 to pivot, rotate or roll about the pivot axis 137.

Figure 7:
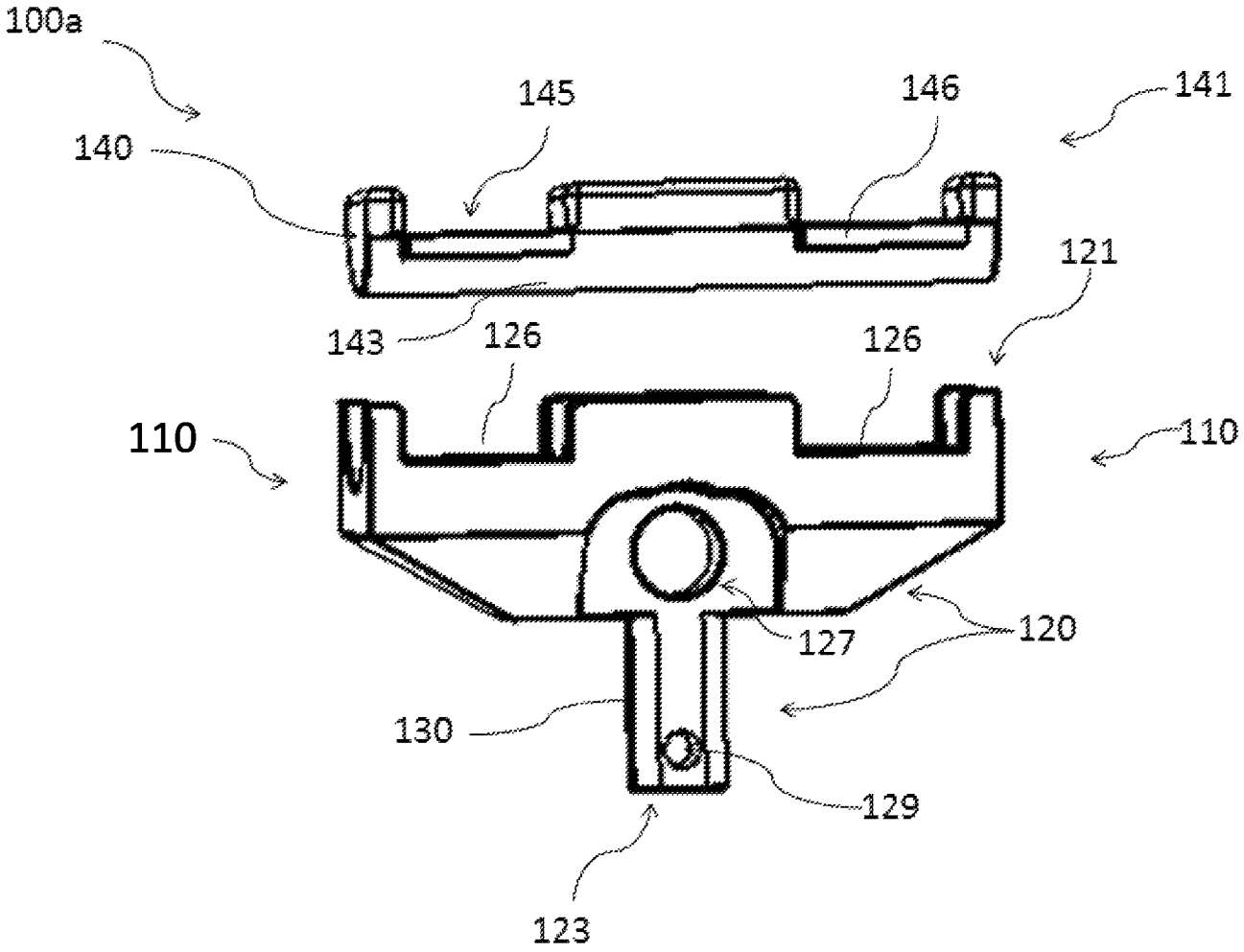
FIG. 7 is an exploded isometric view of an embodiment of an embodiment of the base portion and support portion of the archery limb adjustment system of FIG. 5.
Figure 8:
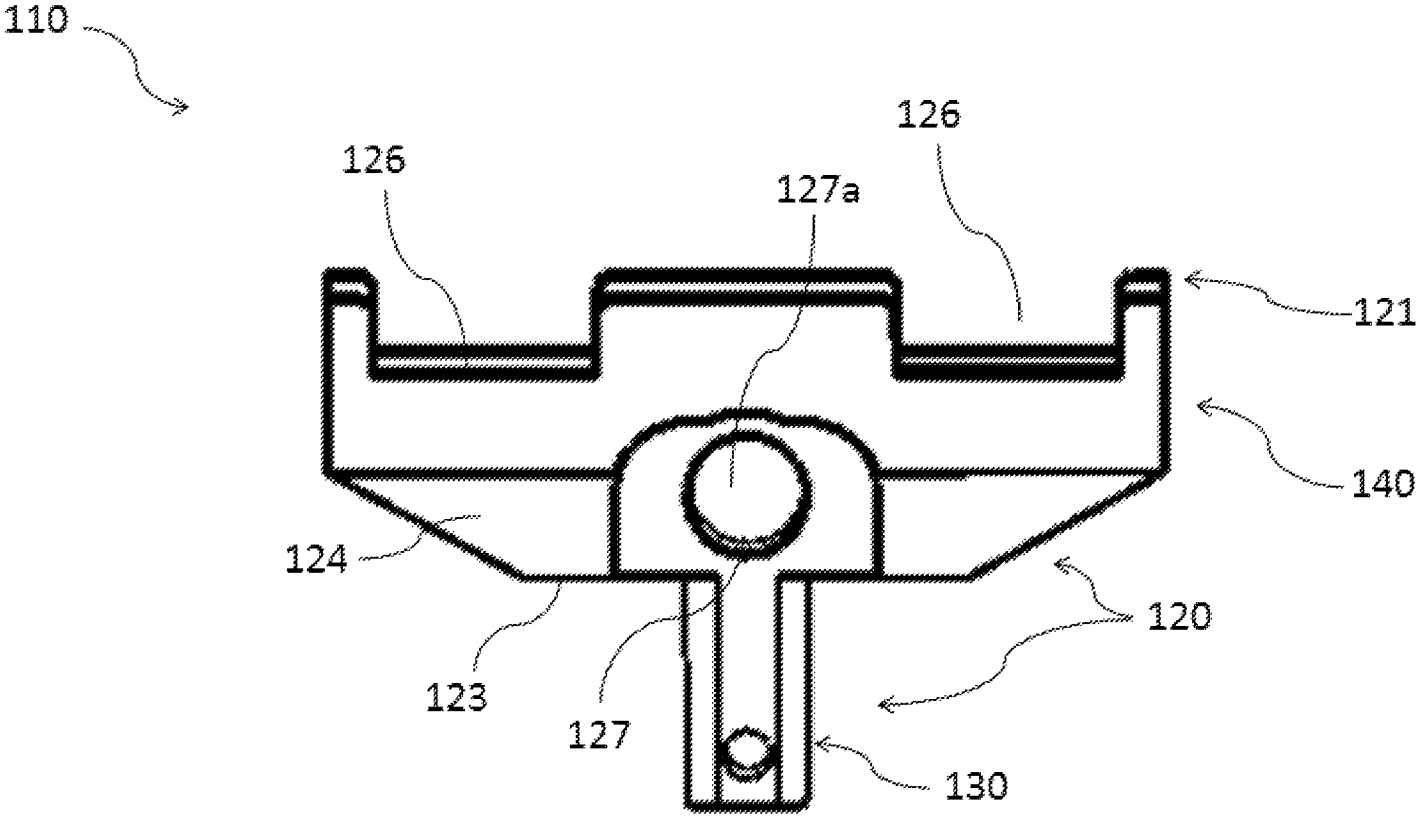
FIG. 8 is a rear isometric view of the base portion of FIG. 7.
Figure 13:
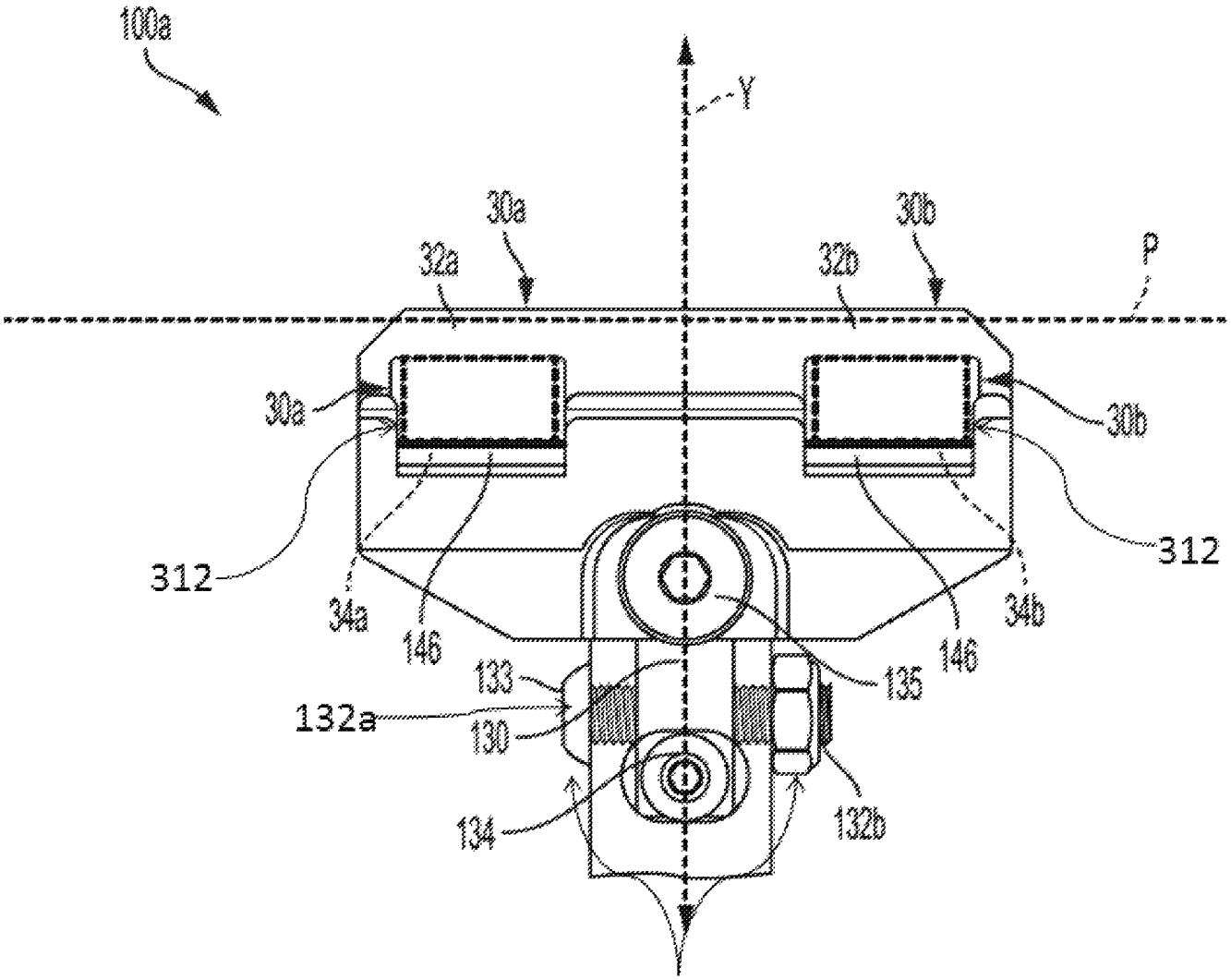
FIG. 13 is a cross-sectional view of the archery limb adjustment system of FIG. 4, taken substantially along line 13-13 of FIG. 2, illustrating the archery limb adjustment system in a neutral position where the base is vertically aligned along plane Y, and the top surfaces of the archery limb portions are aligned along the plane P.

As is shown in FIGS. 5-7 and 11-12, the seat 141 of the archery limb holder 110 is configured to be positioned within the cavity 125 (FIG. 9) of the support portion 140. The seat 141 includes a top surface defining one or more seat cavities 145 that are configured to receive the bottom surfaces 34*a*, 34*b* of the archery limb portions 30*a*, 30*b*, respectively (FIG. 13). In the embodiment shown, each of the seat cavities 145 is defined by a seat surface 146 that extends entirely through the seat 141 beyond a front surface 142 and a rear surface (not shown). When the seat 141 is inserted into the support portion 140 as shown in FIGS. 5-7, the bottom 143 of the seat 141 fits within the cavity 125 and faces or contacts the support portion 140. At the same time, the seat surface 146 extends into the recesses 126 of the support portion 140.

Referring to FIGS. 2-4, 10, and 13, the archery limb holder 110 is coupled to the riser 12 of the archery bow 10 by the pivot member 135. The base member 130 extends into a cavity or pocket 150 defined by the first riser end 11. The pocket 150 (FIGS. 3, 4, and 10) has a dimension 151 (FIG. 4) that is greater than the diameter of the base member 130. The dimension 151 is large enough to allow the base member 130 to rock or swing within the pocket 150 (FIGS. 3, 4, and 10) as the base member 130 pivots about the pivot axis 137 (FIG. 6) when the position adjuster 132 is actuated or operated by a user. Accordingly, the pocket 150 enables the base member 130 to rock or swing like a clock pendulum during the adjustment process. Depending on the embodiment, the dimension 151 can be greater than the diameter of the base member 130 by 5%, 10%, 20%, 30%, 40%, 50%, 60%, 70%, 80%, 100%, or any suitable lower percentage or higher percentage.

FIG. 13 shows a cross sectional view taken substantially along line 13-13 of FIG. 2 through the archery limb portions 30*a*, 30*b*. As shown, the archery limb adjustment system 100*a* is in a neutral position when the base member 130 extends parallel or substantially parallel to a vertical axis Y when the riser 12 is vertically oriented. As shown, the bottom surfaces 34*a*, 34*b* of the archery limb portions 30*a*, 30*b*, respectively, rest on or contact the seat surface 146. A horizontal plane P extends through the top surfaces 32*a*, 32*b* of the archery limb portions 30*a*, 30*b*. In order to adjust at least one of the archery limb portions 30*a*, 30*b*, the user first releases the position lock 134. For example, the user can release the position lock 134 by partially unscrewing the position lock 134 using a suitable wrench or tool. Then, the user can operate the position adjuster 132 to cause the archery limb holder 110 to pivot or rotate about the pivot axis 137 (FIG. 6).

Figure 14:
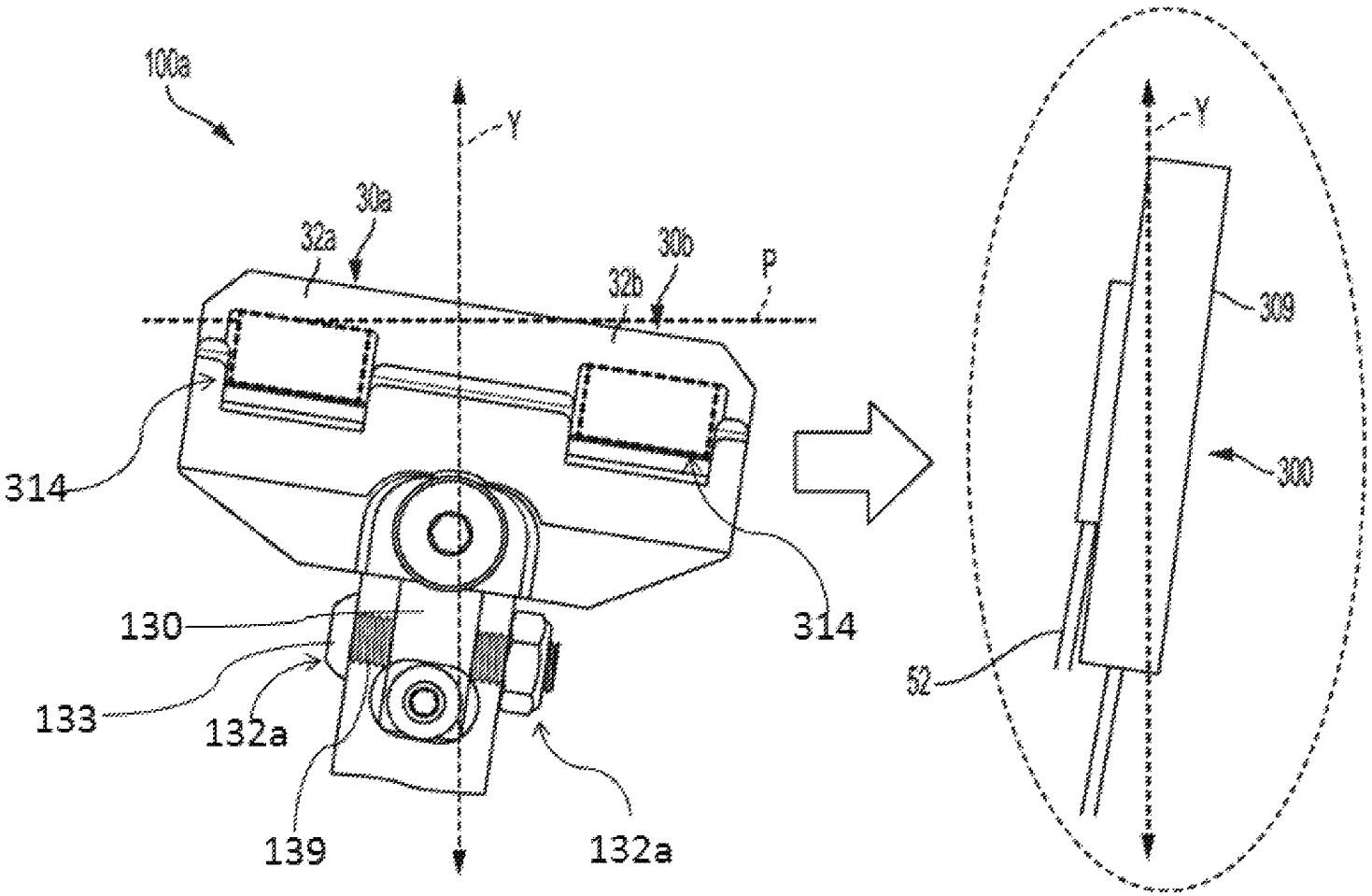
FIG. 14 is a cross-sectional view of the archery limb adjustment system of FIG. 4, taken substantially along line 13-13 of FIG. 2, illustrating the archery limb adjustment system in a tilted position where the base is tilted relative to plane Y, the top surface of a first archery limb portion is partially positioned above the plane P, and the top surface of a second archery limb portion is partially positioned below the plane P corresponding to the tilting of the rotor relative to plane Y.

In the rightward tilting example shown in FIG. 14, the user has rotated the first adjuster portion 132*a* clockwise. The threads of shaft 139 mate with the threads of the first channel 128 (FIG. 9) and the threads of the second adjuster portion 132*b*. This rotation and threaded engagement causes the shaft 139 to axially move through the second adjuster portion 132*b* while causing the base member 130 to move toward the head 133. As a result, the base member 130 pivots or swings to the left. This causes as least part of the top surface 32*a* to pivot and move above the horizontal plane P while causing at least part of the top surface 32*b* to pivot and move below the horizontal plane P. Consequently, (a) the upper portion 309 of the rotor 300 tilts away from the supplemental cords 52; and (b) the tension in or loading of the archery limb portion 30*a* increases, and the tension in or loading of the archery limb portion 30*b* decreases. Such repositioning of the top surfaces 32*a*, 32*b* causes the upper portion 309 of the rotor 300 to tilt or lean rightward as illustrated in FIG. 14.

In a leftward tilting example (not shown), the installer or archer can rotate the first adjuster portion 132*a* counterclockwise. The threads of shaft 139 mate with the threads of the first channel 128 and the threads of the second adjuster portion 132*b*. This rotation and threaded engagement causes the shaft 139 to axially move through the second adjuster portion 132*b* while causing the base member 130 to move away from the head 133. As a result, the base member 130 pivots or swings to the right. This causes at least part of the top surface 32*b* to pivot and move above the horizontal plane P while causing at least part of the top surface 32*a* to pivot and move below the horizontal plane P. Consequently, (a) the upper portion 309 of the rotor 300 tilts toward the supplemental cords 52; and (b) the tension in or loading of the archery limb portion 30*b* increases, and the tension in or loading of archery limb portion 30*a* decreases. Such repositioning of the top surface 32*a*, 32*b* causes the rotor 300 to tilt or lean leftward in a manner opposite to the manner illustrated in FIG. 14. Once the desired position of the archery limb portions 30*a*, 30*b* has been achieved, the archery limb holder 110 can be secured in place via the position lock 134.

Figure 14A:
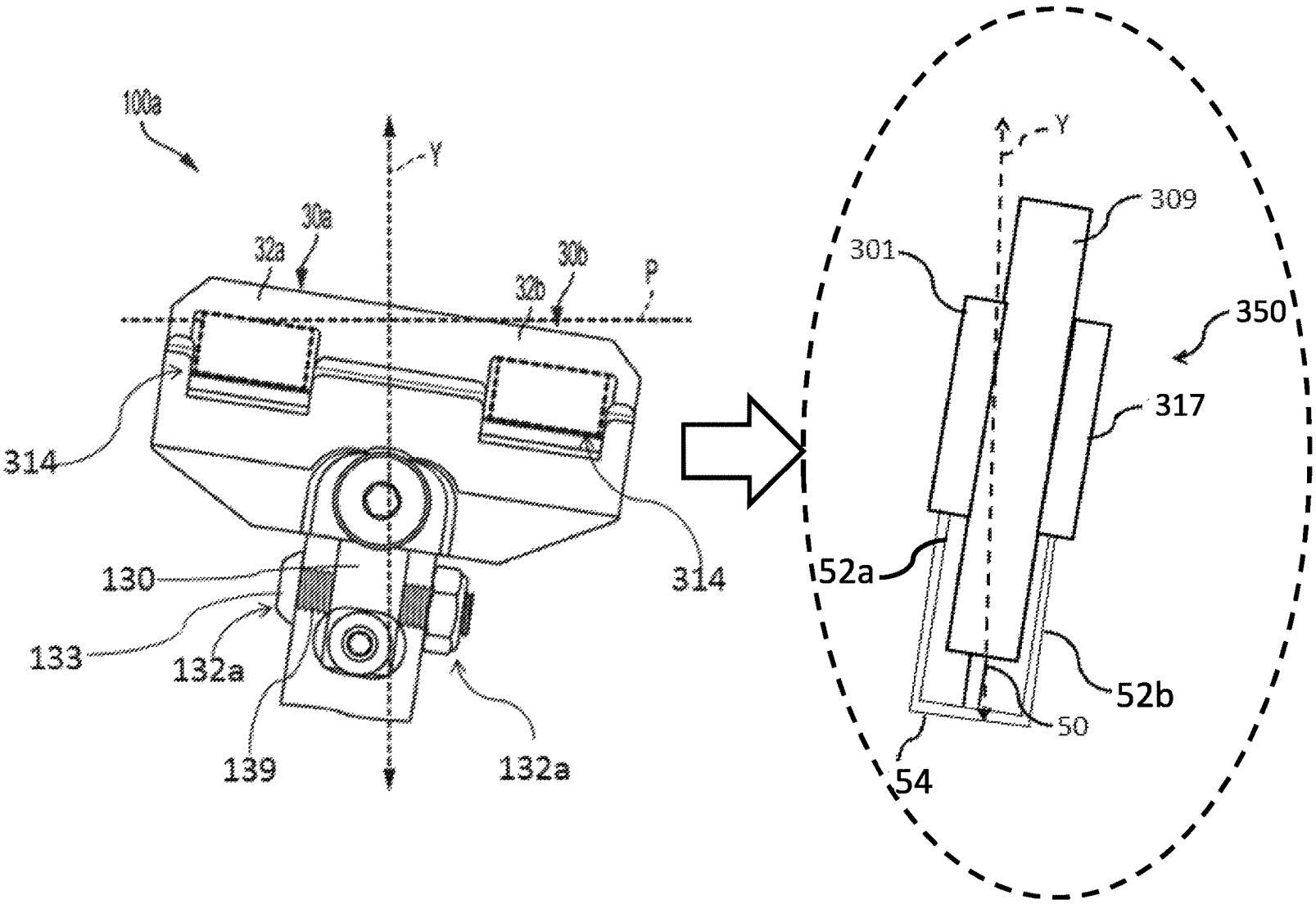
FIG. 14A is a cross-sectional view of the archery limb adjustment system of FIG. 4, taken substantially along line 13-13 of FIG. 2, illustrating the archery limb adjustment system in a tilted position where the base is tilted relative to plane Y, the top surface of a first archery limb portion is partially positioned above the plane P, and the top surface of a second archery limb portion is partially positioned below the plane P corresponding to the tilting of the embodiment of the rotor from FIGS. 1C-1D relative to plane Y.

FIG. 14A illustrates the same rightward tilting as shown in FIG. 14, however here the rotor 350 has two supplemental cords 52*a*, 52*b*, as described above and shown in FIGS. 1C-1D. Again, the user has rotated the first adjuster portion 132*a* clockwise. The threads of shaft 139 mate with the threads of the first channel 128 (FIG. 9) and the threads of the second adjuster portion 132*b*. This rotation and threaded engagement causes the shaft 139 to axially move through the second adjuster portion 132*b* while causing the base member 130 to move toward the head 133. As a result, the base member 130 pivots or swings to the left. This causes as least part of the top surface 32*a* to pivot and move above the horizontal plane P while causing at least part of the top surface 32*b* to pivot and move below the horizontal plane P. Consequently, (a) the upper portion 309 of the rotor 350 tilts away from the supplemental cord 52*a* and tilts towards supplemental cord 52*b*; and (b) the tension in or loading of the archery limb portion 30*a* increases, and the tension in or loading of the archery limb portion 30*b* decreases. Such repositioning of the top surfaces 32*a*, 32*b* causes the upper portion 309 of the rotor 350 to tilt or lean rightward as illustrated in FIG. 14A.

Accordingly, in an embodiment, a single input (e.g., a clockwise or counterclockwise full or partial rotation of the first adjuster portion 132*a*) causes at least the following multiple outcomes: (a) the pivoting or tilting of the archery limb portion 30*a* relative to the riser 12; and (b) the pivoting or tilting of the archery limb portion 30*b* relative to the riser 12. Consequently, in such embodiment, such single input causes the rotor 300 to pivot or tilt according to the archer's fine-tuning preferences. Before the use of the limb adjustment system 100*a*, the archery limb 26 has a first shape 312, as shown in FIG. 13. In response to the use of the limb adjustment system 100*a*, the archery limb 26 transitions to a second shape 314, as shown in FIG. 14. For example, in the first shape 312, the archery limb 26 can be non-twisted, and in the second shape 314, the archery limb 26 can be partially twisted by intention. Therefore, the limb adjustment system 100*a* provides the user with a user friendly and convenient way to tilt the rotor 300 to achieve the archer's preferences. This aids the user in achieving better shooting accuracy and performance.

Figures 15A, 15B:
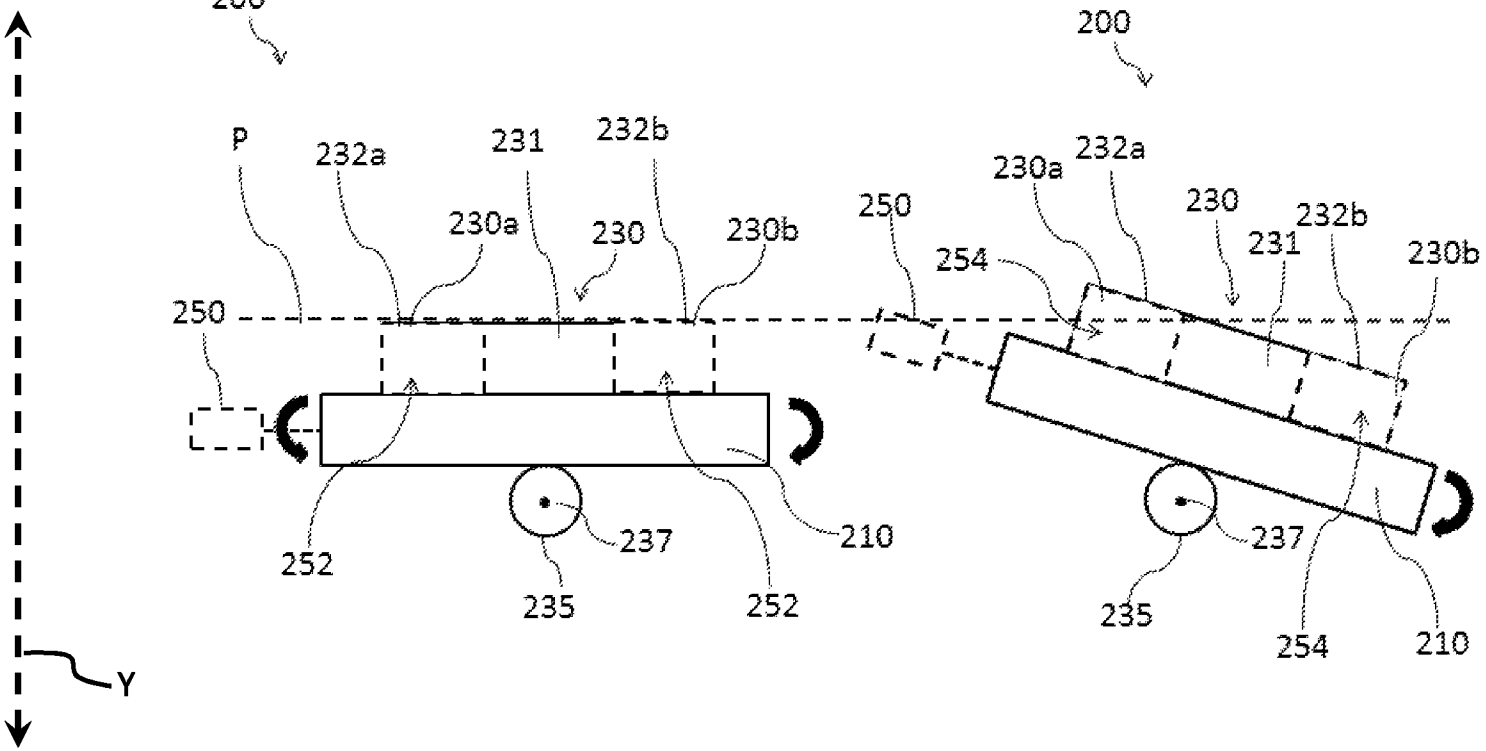
FIG. 15A is a schematic view of an embodiment of an archery limb adjustment system positioned in a neutral position.
FIG. 15B is a schematic view of the archery limb adjustment system of FIG. 15A positioned in an adjusted position corresponding to the tilting of a rotor relative to plane Y.

In another embodiment illustrated in FIGS. 15A-15B, the archery limb adjustment system 200 is configured to hold an archery limb 230. The archery limb adjustment system 200 includes an archery limb holder 210, a pivot member 235 coupled to the archery limb holder 210, and an archery limb adjuster 250. The archery limb holder 210 is configured to contact or support part of the archery limb 230. The archery limb holder 210 and the pivot member 235 are configured and arranged to cooperate so that the archery limb holder 210 is rotatable or pivotal relative to the riser 12. The rotation or pivoting of the archery limb holder 210 occurs in response to the operation or actuation of the archery limb adjuster 250.

The archery limb 230 includes a first limb portion 230*a* with a top surface 232*a* and a second limb portion 230*b* with a top surface 232*b*. Depending on the embodiment: (a) the section 231 between the first and second limb portions 230*a*, 230*b* can be a continuous, solid section, in which case the first and second limb portions 230*a*, 230*b* unitarily form the archery limb 230; or (b) the section 231 can be a cavity or empty space in which case the archery limb 230 has a split limb configuration. As shown in FIG. 15A, the archery limb holder 210 is in the neutral position such that plane P extends through the top surfaces 232*a*, 232*b*. One or more inputs into the archery limb adjuster 250 causes the archery limb holder 210 to rotate or pivot about the pivot member 235 such that one of the top surfaces 232*a*, 232*b* breaks the horizontal plane P.

The pivoting of the first and second limb portions 230*a*, 230*b* causes the rotor 300 that is coupled to the archery limb 230 to tilt or lean as shown in FIGS. 1B and 14. FIG. 1A illustrates the neutral position of the rotor 300 when the archery limb holder 210 is in the neutral position, as described above. As shown, the rotor 300 extends along central plane 305 when in the neutral position. The central plane 305 is parallel or substantially parallel to the vertical axis Y (FIGS. 1, 15A and 15B) when the archery bow 10 is held or oriented in a vertical position.

Before operating the position adjuster 250, the archery limb 230 has a first shape 252, as shown in FIG. 15A. The positioning of at least part of the first and second limb portion 230*a* or 230*b* above the horizontal plane P, by adjustment of the position adjuster 250, causes the following: (a) the archery limb 230 to transition from the first shape 252 to a second shape 254; and (b) the upper portion 309 of the rotor 300 to tilt toward or away from the supplemental cords 52 (FIG. 14). For example, in the first shape 252, the archery limb 230 can be non-twisted, and in the second shape 254, the archery limb 230 can be angularly repositioned or partially twisted by intention. Such adjustment can cause: (a) the upper portion 309 of the rotor 300 to tilt toward the supplemental cords 52; or (b) the upper portion 309 of the rotor 300 to tilt toward away from the supplemental cords 52, as shown in FIG. 14.

Depending on the embodiment, the pivot member 235 can be any suitable fulcrum, pivot device or coupling device, such as a pin, rod, shaft, ball, joint, hinge or other suitable device that enables the archery limb holder 210 to pivot, rotate, roll or move about the pivot axis 237. Also, the archery limb holder 210 can include any geometry, structure or configuration that enables the archery limb holder 210 to dynamically interface with the pivot member 235. Furthermore, the archery limb adjuster 250 can include any mechanical, electromechanical, electrical or electronic device or apparatus that is configured and operable to: (a) transmit an input that originates with a manual force provided by a user; or (b) generate an input, such as a force transmitted by a drive shaft or receiver that is moved by the power of motor, electromagnet, solenoid or pneumatic device. In either case, such input causes the archery limb holder 210 to pivot, rotate, roll or move about the pivot axis 237.

In an embodiment, the first riser end 11, the limb adjustment system 100*a*, the archery limb 26 and the rotor 300 coupled thereto are identical in structure to the second riser end 13, the limb adjustment system 100*b*, the archery limb 28, and the rotor 300 coupled thereto. Therefore, the foregoing description of the limb adjustment system 100*a* applies to, and describes, the limb adjustment system 100*b*. Likewise, two archery limb adjustment systems 200 can replace the limb adjustment systems 100*a*, 100*b*, respectively, on the archery bow 10.

Referring to FIG. 16, each of the limb adjustment systems 100*a*, 100*b*, 200 is configured and operable to cause at least a limb portion 402 of an archery limb 26, 28 (FIG. 1) to transition from an initial shape (such as the non-twisted shape of the limb portion 30*a*, 30*b* shown in FIG. 2) to a partially twisted shape 404. In the initial shape, a cross-section 406 of the limb portion 402 extends along a horizontal axis 408 when the archery bow 10 is vertically oriented. In the twisted shape 404, the cross-section 406 extends along an axis 410 that is oriented at an angle 412 relative to the horizontal axis 408. Each of the limb adjustment systems 100*a*, 100*b*, 200 is operable to produce a torque along the limb portion 402. The limb portion 402 has a torsion constant and a torsional stiffness that affect the response to the positional adjustment caused by either one of the limb adjustment systems 100*a*, 100*b*, 200.

The parts, components, and structural elements of each of the limb adjustment systems 100*a*, 100*b*, 200 can be combined into an integral or unitary, one-piece object, or such parts, components, and structural elements can be distinct, removable items that are attachable to each other through screws, bolts, pins and other suitable fasteners. For example, the seat 141 can be unitary with the support portion 140, and the support portion 140 can be separate from, but coupled to, the base portion 120.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with, fit with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery limb adjustment system comprising:

an archery limb holder configured to be coupled to an archery bow, wherein the archery limb holder is configured to hold an archery limb that comprises a plurality of archery limb portions, wherein each of the archery limb portions comprises a top surface, wherein a plane extends through the top surfaces of the archery limb portions when the archery limb comprises a first shape;

a pivot member configured to be coupled to the archery bow, wherein the pivot member is configured to pivotally support the archery limb holder; and an archery limb adjuster operatively coupled to the archery limb holder, wherein the archery limb adjuster is configured to receive an input, wherein the archery limb holder, the pivot member and the archery limb adjuster are configured to cooperate so that, in response to the input, the archery limb holder is configured to pivot relative to the archery bow when the archery limb holder and the pivot member are coupled to the archery bow, wherein, as a result of the pivoting of the archery limb holder, the archery limb is transitioned to a second shape in which one of the top surfaces is at least partially moved above the plane, and another one of the top surfaces is at least partially moved below the plane.

2. The archery limb adjustment system of claim 1, wherein the archery limb holder further comprises:

a base portion comprising a base member extending from the base portion; and a support portion comprising a seat configured to engage the archery limb.

3. The archery limb adjustment system of claim 1, wherein the archery limb adjuster is configured to extend at least partially through the archery limb holder.

4. The archery limb adjustment system of claim 3, comprising a position lock member configured to prevent the archery limb holder from pivoting relative to the archery bow.

5. The archery limb adjustment system of claim 2, wherein the support portion and the base portion are formed as a single unitary component.

6. The archery limb adjustment system of claim 1, wherein:

the archery bow is configured to be oriented along a vertical axis;

the archery bow comprises at least one rotor coupled to the archery limb;

the rotor is configured to extend along a central plane that is substantially parallel with the vertical axis when the archery limb comprises the first shape; and the central plane is tilted relative to the vertical axis when the archery limb comprises the second shape.

7. An archery limb adjustment system comprising:

an archery limb holder configured to be coupled to an archery bow, wherein the archery bow comprises a front surface, wherein a front plane extends through the front surface;

a pivot member configured to support the archery limb holder; and an archery limb adjuster operatively coupled to the archery limb holder, wherein the archery limb adjuster is configured to receive an input, wherein the archery limb holder is configured to be pivoted about a pivot axis relative to the archery bow in response to the input, wherein the pivot axis intersects with the front plane.

8. The archery limb adjustment system of claim 7, wherein the archery limb holder further comprises:

a base portion comprising a base member extending from the base portion; and a support portion comprising a seat configured to engage the archery limb.

9. The archery limb adjustment system of claim 7, wherein the limb adjuster is configured to extend at least partially through the archery limb holder.

10. The archery limb adjustment system of claim 9, comprising a position lock member configured to prevent the archery limb holder from pivoting relative to the archery bow.

11. The archery limb adjustment system of claim 7, wherein the archery bow is configured to be oriented so that the front surface faces in a direction toward a target.

12. The archery limb adjustment system of claim 7, wherein:

the archery bow comprises a plurality of sides;

when the archery bow is oriented upright during shooting, a region of the archery bow extends along a longitudinal axis, and another region of the archery bow extends along a lateral axis that passes through the sides;

the archery limb holder comprises a holder surface configured to engage a portion of at least one archery limb;

a section of the holder surface extends along the lateral axis;

the section comprises a plurality of parts; and as a result of the pivoting of the archery limb holder, a plurality of the parts of the section comprise a plurality of different positions relative to the longitudinal axis.

13. An archery limb adjustment system comprising:

an archery limb holder configured to be coupled to an archery bow;

a pivot member configured to support the archery limb holder; and an archery limb adjuster operatively coupled to the archery limb holder, wherein the archery limb adjuster is configured to receive an input, wherein the archery limb holder, the pivot member and the archery limb adjuster are configured to cooperate so that, in response to the input, the archery limb holder is configured to pivot relative to the archery bow when the archery limb holder and the pivot member are coupled to the archery bow, and wherein the archery limb holder is configured to hold an archery limb that comprises a plurality of archery limb portions each comprising a top surface, wherein a plane extends through the top surfaces of the archery limb portions when the archery limb comprises a first shape, and wherein, as a result of the pivoting of the archery limb holder, the archery limb is transitioned to a second shape in which one of the top surfaces is moved at least partially above the plane, and another one of the top surfaces is moved at least partially below the plane.

14. The archery limb adjustment system of claim 13, wherein the archery bow comprises at least one rotor coupled to the archery limb and aligned in a neutral position when the archery limb comprises the first shape, and wherein the at least one rotor is tilted relative to the neutral position when the archery limb comprises the second shape.

15. A method for manufacturing an archery limb adjustment system, the method comprising:

configuring an archery limb holder to be coupled to an archery bow, wherein the archery bow comprises a front surface, wherein a plane extends through the front surface;

configuring a pivot member to support the archery limb holder; and configuring an archery limb adjuster so as to be operatively coupled to the archery limb holder, wherein the archery limb holder is configured to pivot relative to the archery bow about a pivot axis, wherein the pivot axis extends toward the plane.

16. The method of claim 15, comprising configuring the archery limb adjuster to extend at least partially through the archery limb holder.

17. The method of claim 15, comprising coupling a position lock member to the archery limb holder so as to prevent the archery limb holder from pivoting relative to the archery bow.

18. A method for manufacturing an archery limb adjustment system, the method comprising:

configuring an archery limb holder to be coupled to an archery bow;

configuring a pivot member to support the archery limb holder; and configuring an archery limb adjuster so as:

to be operatively coupled to the archery limb holder;

to receive an input, and to hold an archery limb that comprises a plurality of archery limb portions each comprising a top surface, wherein the archery limb holder, the pivot member and the archery limb adjuster are configured to cooperate so that, in response to the input, the archery limb holder is configured to pivot relative to the archery bow when the archery limb holder and the pivot member are coupled to the archery bow, wherein a plane extends through the top surfaces of the archery limb portions when the archery limb comprises a first shape, and wherein, as a result of the pivoting of the archery limb holder, the archery limb is transitioned to a second shape in which one of the top surfaces is at least partially moved above the plane, and another one of the top surfaces is at least partially moved below the plane.

19. The method of claim 18, wherein:

the archery bow comprises at least one rotor coupled to the archery limb and aligned in a neutral position when the archery limb comprises the first shape, and as a result of the input, the at least one rotor is tilted relative to the neutral position when the archery limb comprises the second shape.

20. The method of claim 19, comprising configuring the archery limb holder so as to comprise:

a base portion comprising a base member extending from the base portion; and a support portion coupled to the base portion and comprising a seat configured to engage the archery limb.

21. The method of claim 20, comprising configuring the seat so as to be removably coupled to the base portion.

* * * * *